United States Patent [19]

Yagihara et al.

[11] Patent Number: 4,977,062

[45] Date of Patent: Dec. 11, 1990

[54] SILVER HALIDE PHOTOGRAPHIC MATERIALS

[75] Inventors: Morio Yagihara; Hisashi Okada; Kazunobu Katoh; Nobuaki Inoue, all of Kanagawa, Japan

[73] Assignee: Fuji Photo Film Co., Ltd., Kanagawa, Japan

[21] Appl. No.: 178,391

[22] Filed: Apr. 6, 1988

[30] Foreign Application Priority Data

Apr. 6, 1987 [JP] Japan ..... 62-84468

[51] Int. Cl.[5] ..... G03C 1/06

[52] U.S. Cl. ..... 430/264; 430/566

[58] Field of Search ..... 430/264, 436, 566, 598

[56] References Cited

U.S. PATENT DOCUMENTS

| | | | |
|---|---|---|---|
| 4,224,401 | 9/1980 | Takada et al. . | |
| 4,243,739 | 1/1981 | Mifune et al. . | |
| 4,269,929 | 5/1981 | Nothnagle . | |
| 4,385,108 | 5/1983 | Takagi et al. . | |
| 4,429,036 | 1/1984 | Hirano et al. . | |
| 4,447,522 | 5/1984 | Hirano et al. . | |
| 4,634,661 | 1/1987 | Cavallaro | 430/567 |
| 4,737,442 | 4/1988 | Yagihara et al. | 430/264 |
| 4,762,769 | 8/1988 | Takahashi et al. | 430/264 |

FOREIGN PATENT DOCUMENTS

| | | | |
|---|---|---|---|
| 0126000 | 11/1984 | European Pat. Off. . | |
| 0130856 | 1/1985 | European Pat. Off. . | |
| 3203661 | 7/1983 | Fed. Rep. of Germany . | |
| 62-270948 | 11/1987 | Japan | 430/598 |
| 2034908 | 6/1980 | United Kingdom . | |

OTHER PUBLICATIONS

Chemical Abstracts, vol. 109, No. 10, p. 667, Sep. 5, 1988, "High-Contrast Silver Halide Photographic Material with Hydrazine Derivative-Containing Emulsion Layer", Inagaki et al, JP 62,270,948, published Nov. 25, 1987.

Research Disclosure, Nov. 1983, No. 235, pp. 346-352, Disclosure #23510, Havant, Hampshire "Development Nucleation by Hydrazine and Hydrazine Derivatives".

*Primary Examiner*—Paul R. Michl

*Assistant Examiner*—Janet C. Baxter

*Attorney, Agent, or Firm*—Sughrue, Mion, Zinn, Macpeak & Seas

[57] ABSTRACT

An ultra-high contrast negative type silver halide photographic material comprising:

(1) at least one silver halide emulsion layer on a support;

(2) at least one compound selected from among hydrazine derivatives which can be represented by formula (I) below, which is included in said emulsion layer or in another hydrophilic colloid layer, (I)

wherein $A_1$ and $A_2$ both represent hydrogen atoms or one represents a hydrogen atom and the other represents a sulfinic acid residual group or an acyl group, $R_1$ represents an aliphatic group, an aromatic group or a heterocyclic group, $R_2$ represents a hydrogen atom, an alkyl group, an aryl group, an alkoxy group, an aryloxy group, or an amino group, $G_1$ represents a carbonyl group, a sulfonyl group, a sulfoxy group, a phosphoryl group or an N-substituted or unsubstituted iminomethylene group, and at least one of $R_1$ and $R_2$ has a group which promotes adsorption on silver halide; and (3) at least one compound selected from among the hydrazine derivatives which can be represented by the formula (II) below, which is included in the said emulsion layer or in another hydrophilic colloid layer, (II)

wherein $A_3$ and $A_4$ both represent hydrogen atoms or one represents a hydrogen atom and the other represents a sulfinic acid residual group or an acyl group, $R_3$ represents an aliphatic group, an aromatic group or a heterocyclic group, $R_4$ represents a hydrogen atom, an alkyl group, an aryl group, an alkoxy group, an aryloxy group or an amino group, $G_2$ represents a carbonyl group, a sulfonyl group, a sulfoxy group, a phosphoryl group, or an iminomethylene group, and the total number of carbon atoms in $R_3$ and $R_4$ is at least 13.

35 Claims, No Drawings

SILVER HALIDE PHOTOGRAPHIC MATERIALS

FIELD OF THE INVENTION

This invention concerns silver halide photographic materials and a method of forming ultra-high contrast negative images using these materials, and it concerns in particular the silver halide photographic materials which are used in photomechanical processing.

BACKGROUND OF THE INVENTION

Image forming systems which exhibit ultra-high contrast (especially those with a gamma of 10 or above) are essential for achieving good reproduction of continuous tone images by means of a screened image and good reproduction of line images in the graphic arts field.

U.S. Pat. Nos. 4,224,401, 4,168,977, 4,166,742, 4,311,781, 4,272,606 and 4,211,857, etc. disclose methods in which high contrast photographic characteristics are obtained using stable development baths in which use is made of hydrazine derivatives. Photographic characteristics with high speed at ultra-high contrast are obtained with these methods, and moreover the presence of high concentration of sulfite can be tolerated in the development bath, and so the stability of the development bath in response to aerial oxidation is much better than that of the lith developers.

However, the hydrazine compounds known in the past have had a number of distinct disadvantages. Thus attempts have been made to provide hydrazine compounds with structures which are fast-to-diffusion. Such attempts have been made with a view to reducing the level of the adverse effects on other photographic materials caused by the washing out of the conventional hydrazine compounds into the development processing bath. These non-diffusible hydrazine compounds must be used in large quantities in order to provide sensitization for contrast enhancement, and the large quantities occasionally lead to a deterioration of the physical strength of the photosensitive layers obtained. The large quantities also cause problems with the precipitation of the hydrazine compounds in coating liquids. Moreover, it has not been possible to obtain a sufficiently high contrast when processing has been carried out in an exhausted development bath in which a large quantity of photosensitive material has been processed.

The provision of very high contrast images using hydrazines which have a substituent group which is readily adsorbed on silver halide grains has been disclosed in U.S. Pat. Nos. 4,385,108, 4,269,929 and 4,243,739. However, although contrast is enhanced with these adsorption type hydrazine compounds, the maximum image density obtained is low, and there is also a problem with printing materials. The problems is that reduction, as routinely performed, is virtually impossible since the image density is inevitably low before reducing the screen area. Moreover, if the material is processed in an exhausted bath which has undergone aerial oxidation, then there are problems with large fluctuations on the high speed side.

The contrast enhancing ability of the conventional hydrazine compounds is inadequate, as has been indicated above. Therefore, the compounds must be used in large quantities, and this may have an adverse effect on the physical properties of the film. The maximum image density may become inadequate and problems can arise with large fluctuations in the photographic characteristics depending on the working state of the development bath. The resolution of these problems is clearly desirable.

SUMMARY OF THE INVENTION

As a result of thorough research carried out by the inventors, these problems have been resolved by using at least two types of hydrazine compounds.

The above mentioned aim has been achieved by means of ultra-high contrast negative type silver halide photographic materials of which the distinguishing features are (1) they have at least one silver halide emulsion layer on a support, (2) they have at least one compound selected from among the hydrazine derivatives which can be represented by formula (I) below, (3) they have at least one compound selected from among the hydrazine derivatives which can be represented by the general formula (II) below, and (4) they are included in the said emulsion layer or in another hydrophilic colloid layer.

Formula (I)

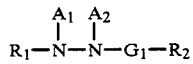

(I)

In this formula, $A_1$ and $A_2$ both represent hydrogen atoms or one represents a hydrogen atom and the other represents a sulfinic acid residual group or an acyl group. $R_1$ represents an aliphatic group, aromatic group or heterocyclic group. $R_2$ represents a hydrogen atom, substituted or unsubstituted alkyl group, substituted or unsubstituted aryl group, substituted or unsubstituted alkoxy group, substituted or unsubstituted aryloxy group, or a substituted or unsubstituted amino group. $G_1$ represents a carbonyl group, sulfonyl group, sulfoxy group, phosphoryl group or an N-substituted or unsubstituted iminomethylene group.

Here at least one of $R_1$ and $R_2$ has a group which promotes adsorption on silver halide.

Formula (II)

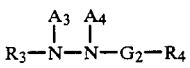

(II)

In this formula, $A_3$ and $A_4$ both represent hydrogen atoms or one represents a hydrogen atom and the other represents a sulfinic acid residual group or an acyl group. $R_3$ represents an aliphatic group, aromatic group or heterocyclic group. $R_4$ represents a hydrogen atom, substituted or unsubstituted alkyl group, substituted or unsubstituted aryl group, substituted or unsubstituted alkoxy group, substituted or unsubstituted aryloxy group or a substituted or unsubstituted amino group. $G_2$ represents a carbonyl group, sulfonyl group, sulfoxy group, phosphoryl group, or an N-substituted or unsubstituted iminomethylene group.

Here the total number of carbon atoms in $R_3$ and $R_4$ is at least 13.

DETAILED DESCRIPTION OF THE INVENTION

The aliphatic groups which can be represented by $R_1$ in formula (I) preferably have 1 to 60 carbon atoms and include linear chain, branched or cyclic alkyl groups, alkenyl groups or alkynyl groups.

The aromatic groups which can be represented by $R_1$ preferably have 6 to 60 carbon atoms and include single ring or double ring aryl groups, for example, phenyl groups or naphthyl groups.

The heterocyclic rings of $R_1$ are 3- to 10-membered saturated or unsaturated heterocyclic rings which contain at least one nitrogen, oxygen or sulfur atom, and they may be single rings or they may take the form of rings condensed with aromatic rings or other heterocyclic rings. The preferred heterocyclic groups are 5- or 6-membered aromatic heterocyclic groups, for example, a pyridine group, imidazolyl group, quinolinyl group, benzimidazolyl group, pyrimidyl group, pyrazolyl group, isoquinolinyl group, thiazolyl group, benzthiazolyl group, etc.

$R_1$ may be substituted with substituent groups. Examples of substituent groups are indicated below. These groups may also be substituted.

For example, the substituents may be alkyl groups, aralkyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxyl groups, halogen atoms, cyano groups, sulfo groups and carboxyl groups, etc.

Where possible, these groups may be joined together to form a ring.

Aromatic groups are preferred for $R_1$, and aryl groups are especially desirable.

Of the groups which can be represented by $R_2$, a hydrogen atom, an alkyl group (for example, a methyl group, trifluoromethyl group, 3-hydroxypropyl group, 3-methanesulfonamidopropyl group, etc.), an aralkyl group (for example, an o-hydroxybenzyl group, etc.), an aryl group (for example, a phenyl group, 3,5-dichlorophenyl group, o-methanesulfonamidophenyl group, 4-methanesulfonylphenyl group, etc.), etc. is preferred when $G_1$ is a carbonyl group, and of these groups the hydrogen atom is most preferable.

Furthermore, when $G_1$ is a sulfonyl group then $R_2$ is preferably an alkyl group (for example, a methyl group, etc.), an aralkyl group (for example, an o-hydroxyphenylmethyl group, etc.), an aryl group (for example, a phenyl group, etc.) or a substituted amino group (for example, a dimethyl amino group, etc.), etc.

When $G_1$ is a sulfoxy group, then $R_2$ is preferably a cyanobenzyl group, methylthiobenzyl group, etc., and when $G_1$ is a phosphoryl group, then $R_2$ is preferably a methoxy group, ethoxy group, butoxy group, phenoxy group, or a phenyl group, and most desirably it is a phenoxy group.

When $G_1$ is an N-substituted or unsubstituted iminomethylene group, then $R_2$ is preferably a methyl group, ethyl group, or a substituted or unsubstituted phenyl group.

The above mentioned substituents of $R_1$ may be used as substituent groups of $R_2$, and the possible substituent groups for $R_2$ also include, for example, acyl groups, acyloxy groups, alkyl or aryl oxycarbonyl groups, alkenyl groups, alkynyl groups and nitro groups, etc.

These substituent groups may also be substituted with substituent groups. Where possible, these groups may be joined together to form a ring.

Groups which promote adsorption on silver halide which can be substituted into $R_1$ or $R_2$ can be represented by $X_1$-$(L_1)_m$.

Here $X_1$ is a group which promotes adsorption on silver halide, and $L_1$ is a divalent linking group. Moreover m has a value of 0 or 1.

Examples of the preferred groups which promote adsorption on silver halide which can be represented by $X_1$ include the thioamido group, the mercapto group, groups which have a disulfide bond, and 5- or 6-membered nitrogen-containing heterocyclic groups.

The thioamido groups which promote adsorption which can be represented by $X_1$ may be divalent groups which can be represented by $$-\overset{\overset{\displaystyle S}{\|}}{C}\text{-amino-}$$

and this may form part of a ring structure, or they may be a non-cyclic thioamido groups. Useful thioamido adsorption promoting groups can be selected from among those disclosed, for example, in U.S. Pat. Nos. 4,030,925, 4,031,127, 4,080,207, 4,245,037, 4,255,511, 4,266,013 and 4,276,364 and in *Research Disclosure,* Vol. 151, No. 15162 (November, 1976) and *Research Disclosure,* Vol. 176, No. 17626 (December, 1978).

Actual examples of non-cyclic thioamide groups include thioureido groups, thiourethane groups, and dithiocarbamic acid ester groups, etc., and actual examples of cyclic thioamido groups include 4-thiazolin-2-thione, 4-imidazolin-2-thione, 2-thiohydantoin, rhodanine, thiobarbituric acid, tetrazolin-5-thione, 1,2,4-triazolin-3-thione, 1,3,4-thiadiazolin-2-thione, 1,3,4-oxadiazolin-2-thione, benzimidazolin-2-thione, benzoxazolin-2-thione and benzothiazolin-2-thione, etc. These may also be substituted.

The mercapto group of $X_1$ is an aliphatic mercapto group, an aromatic mercapto group or a heterocyclic mercapto group (in cases where the nitrogen atom is adjacent to the carbon atom to which the -SH group is bonded, this is the same as the cyclic thioamido group which is related to it tautomerically, and actual examples of these groups are the same as those cited above).

The 5- and 6-membered heterocyclic groups which can be represented by $X_1$ are 5- or 6-membered nitrogen-containing heterocyclic rings which consist of a combination of nitrogen, oxygen, sulfur and carbon atoms. Of these, benzotriazole, triazole, tetrazole, indazole, benzimidazole, imidazole, benzothiazole, thiazole, benzooxazole, oxazole, thiadiazole, oxadiazole or triazine, etc. are preferred. These may also be substituted with appropriate substituent groups. Appropriate substituent groups may be those described for $R_1$.

Of the groups which can be represented by $X_1$, a cyclic thioamido group (which is to say, a mercapto substituted nitrogen-containing heterocyclic group, for example, a 2-mercaptothiadiazole group, 3-mercapto-1,2,4-triazole group, 5-mercaptotetrazole group, 2-mercapto-1,3,4-oxadiazole group, 2-mercaptobenzoxazole group, etc.) or a nitrogen-containing heterocyclic group (for example, a benzotriazole group, a benzimidazole group, indazole group, etc.) is preferred.

Furthermore, two or more $X_1$-$(L_1)_m$ groups may be substituted and these may be the same or different.

The divalent linking group represented by $L_1$ is an atom or atomic group which includes at least one atom selected from among carbon, nitrogen, sulfur and oxygen. Typically it consists of an alkylene group, alkenylene group, alkynylene group, arylene group, —O— group, —S— group, —NH— group, —N= group, —CO— group or an —$SO_2$— group (and these groups may have substituents groups), etc., and these may be taken individually or in combinations.

Typical examples are indicated below:

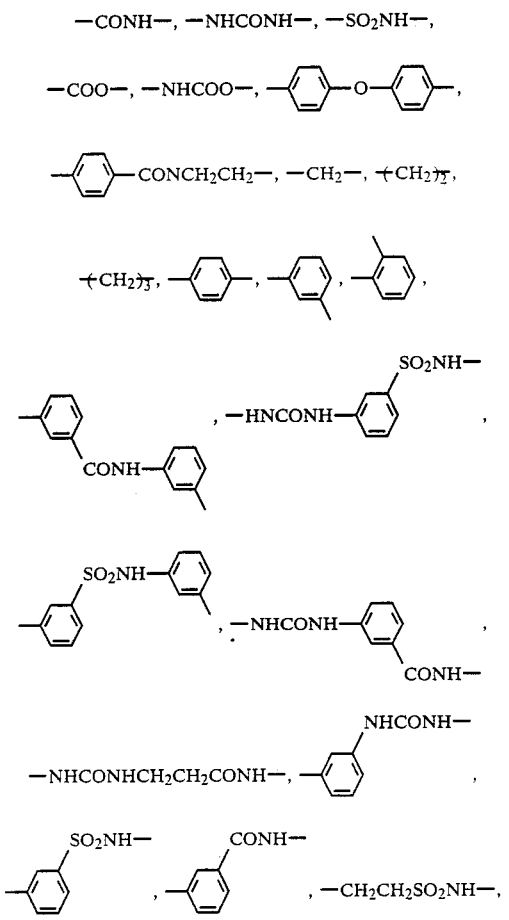

These may be substituted with appropriate substituent groups.

These substituent groups may be those described for $R_1$.

$A_1$ and $A_2$ represent hydrogen atoms, an alkylsulfonyl or arylsulfonyl group which has not more than 20 carbon atoms (preferably a phenylsulfonyl group or a phenylsulfonyl group which has been substituted in such a way that the sum of the Hammett substituent constants is greater than −0.5), an acyl group which has not more than 20 carbon atoms (preferably a benzoyl group or a benzoyl group which has been substituted in such a way that the sum of the Hammett substituent constants is more than —0.5, or a linear chain, branched or cyclic unsubstituted or substituted aliphatic acyl group), examples of the substituent thereof including halogen atoms, ether groups, sulfonamido groups, carboxylamido groups, hydroxyl groups, carboxyl group, sulfonic acid groups. Typical Examples of the sulfinic acid residual group represented by $A_1$ or $A_2$ are those disclosed in U.S. Pat. No. 4,478,928.

Hydrogen atoms are the most desirable groups for $A_1$ and $A_2$.

A carbonyl group is most desirable for $G_1$ in formula (I).

Of those represented by formula (I), compounds represented by formula (III) are preferred.

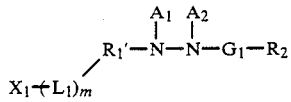

(III)

In this formula, $R'_1$ is a group in which one hydrogen atom has been removed from the group $R_1$ in formula (I). Here, at least one of the groups $R'_1$, $R_2$ and $L_1$ possesses a group which can dissociate to form an anion of which the pKa value is at least 6, or an amino group.

Of the groups which can dissociate to provide an anion of which the pKa value is at least 6, the substituent groups which can dissociate to provide an anion of which the pKa value is 8 to 13 are preferred, and no specific substance is required provided that there is virtually no dissociation in neutral or weakly acidic media and adequate dissociation in aqueous alkaline solutions (preferably of pH 10.5 to 12.3) such as developers.

For example, the substituent group may be a hydroxyl group, a group which can be represented by —$SO_2NH$—, a hydroxyimino group

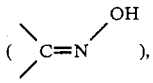

an active methylene group or an active methine group (for example, a —$CH_2COO$— group, a —$CH_2CO$— group or a

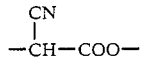

group, etc.

Furthermore, the amino group may be a primary, secondary or tertiary amino group and an amino group of which the pKa value of the conjugate acid is at least 6.0 is preferred.

$A_1$, $A_2$, $G_1$, $R_2$, $L_1$, $X_1$ and m are the same as those described for formula (I).

Of those represented by formula (I), particularly preferred are compounds represented by formula (IV).

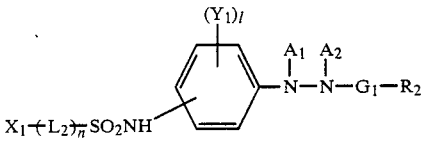

Formula (IV)

In this formula, $L_2$ is the same as $L_1$ in formula (I) or formula (III), $Y_1$ is one of the groups listed as a substituent group for $R_1$ in formula (I), n is 0 or 1, and l is 0, 1 or 2, and when l is 2 then the $Y_1$ groups may be the same or different.

$A_1$, $A_2$, $G_1$, $R_2$ and $X_1$ are the same as those described in formula (I) and formula (III).

Moreover, the $X_1$-$(L_2)_n$-$SO_2NH$ group is preferably substituted in the p-position to the hydrazino group.

In formula (II), $R_3$ is the same as $R_1$ in formula (I), $R_4$ is the same as $R_2$ in formula (I), $A_3$ and $A_4$ are the same as $A_1$ and $A_2$ in general formula (I) and $G_2$ is the same as $G_1$ in formula (I).

In this case, at least one of $R_3$ and $R_4$, and preferably $R_3$, preferably contains the group which is fast-to-diffusion of a coupler, etc., a so-called ballast group. This ballast group has at least 8 carbon atoms, consisting of an alkyl group, phenyl group, ether group, amido group, ureido group, urethane group, sulfonamido group, thioether group, etc. or a combination of these groups.

The total number of carbon atoms in $R_3$ and $R_4$ is at least 13 and preferably between 20 and 60.

Moreover, there is no group for promoting adsorption on silver halide like the substituent group on $R_1$ or $R_2$ of formula (I) in the case of $R_3$ and $R_4$.

Actual examples of compounds which can be represented by formula (I) are indicated below. However, the invention is not limited to these compounds.

I-1

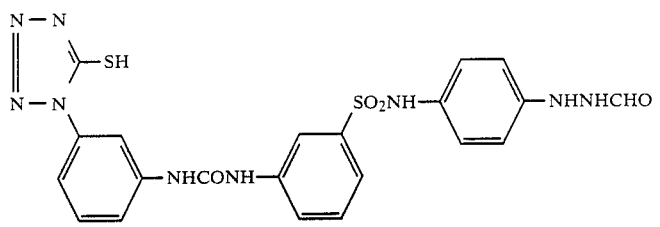

I-2

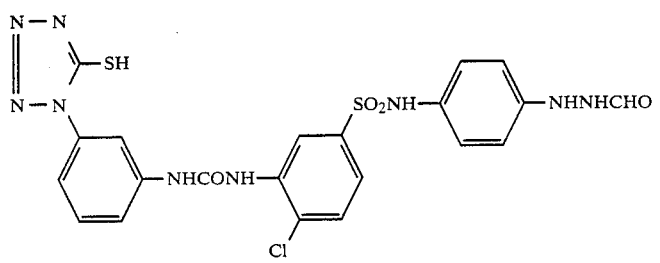

I-3

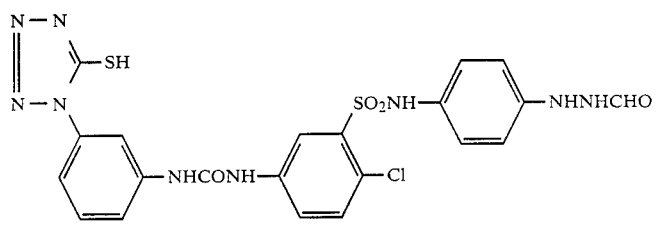

I-4

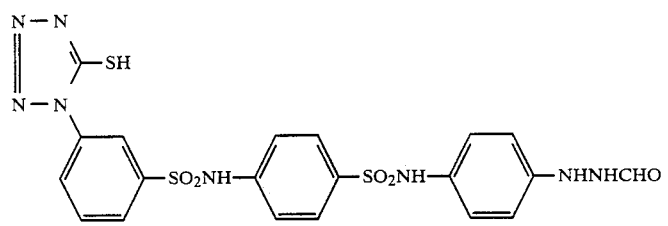

I-5

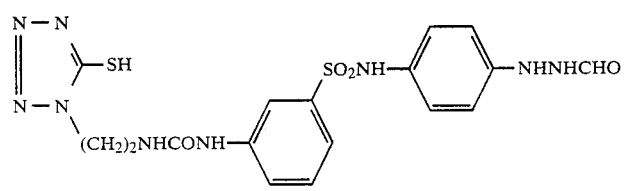

I-6

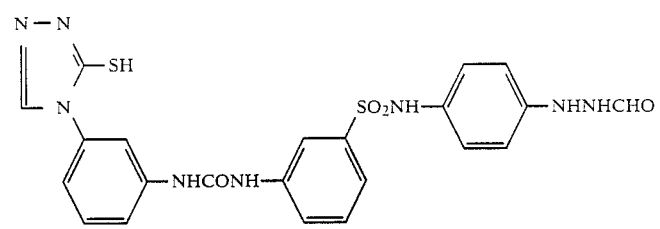

-continued
I-7
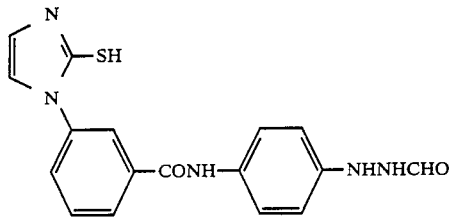
I-8
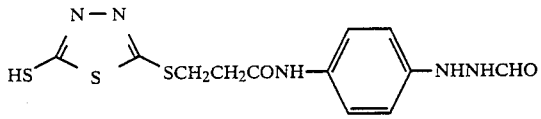
I-9
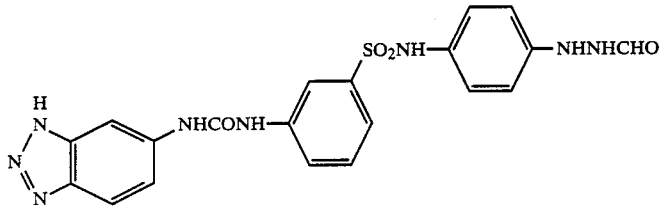
I-10
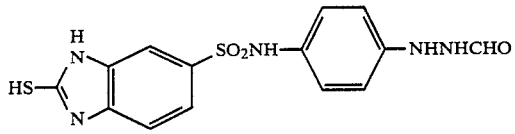
I-11
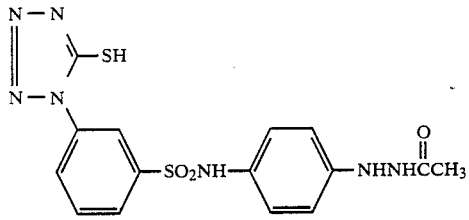
I-12
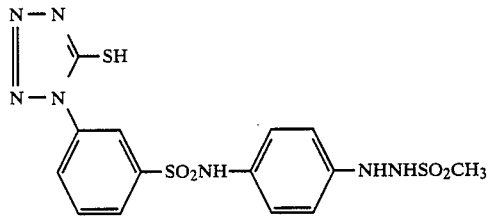
I-13
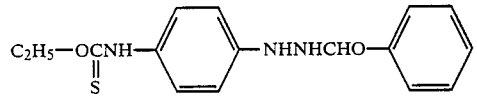
I-14
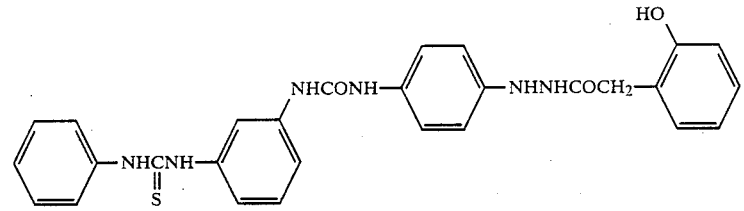

-continued
I-15
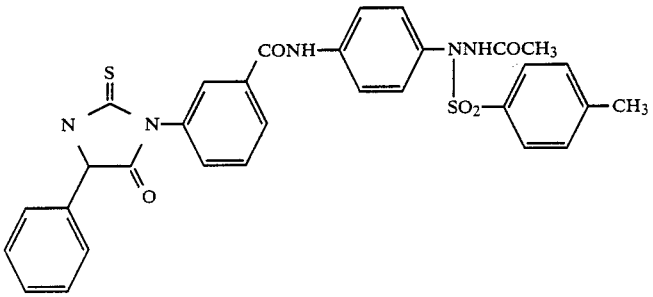
I-16
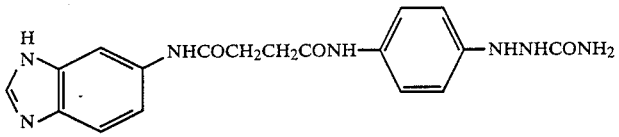
I-17
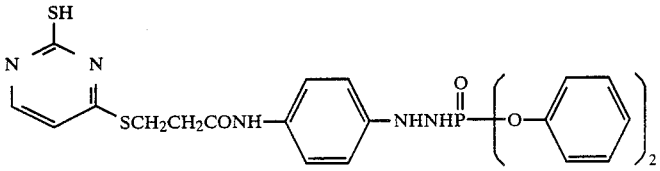
I-18
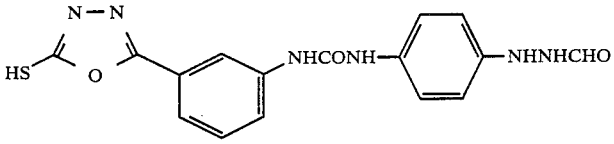
I-19
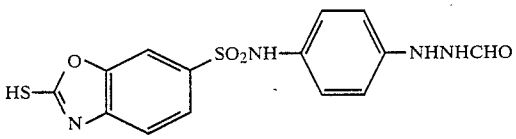
I-20
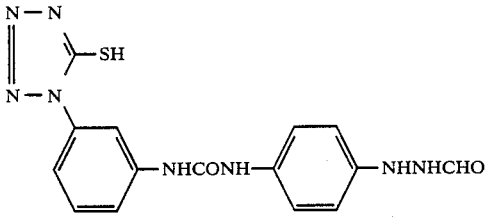
I-21
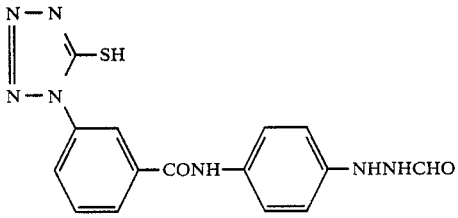
I-22
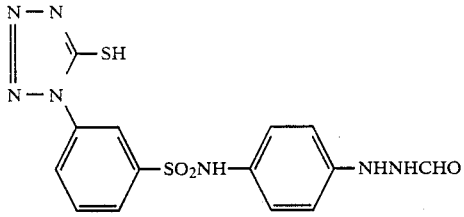

-continued
I-23
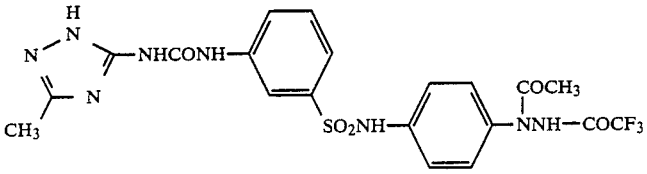
I-24
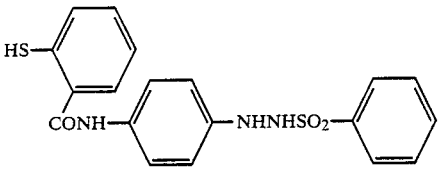
I-25
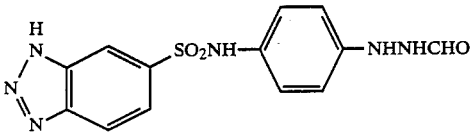
I-26
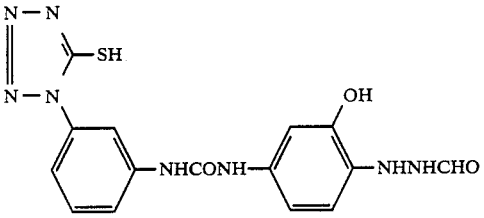
I-27
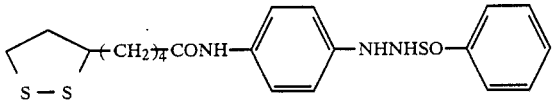
I-28
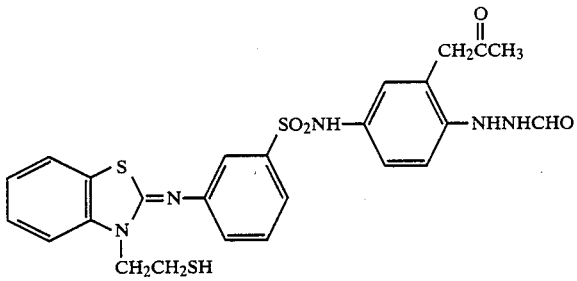
I-29
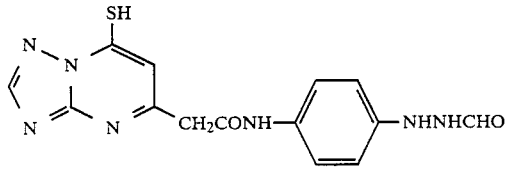
I-30
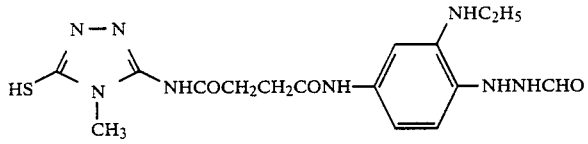

-continued
I-31
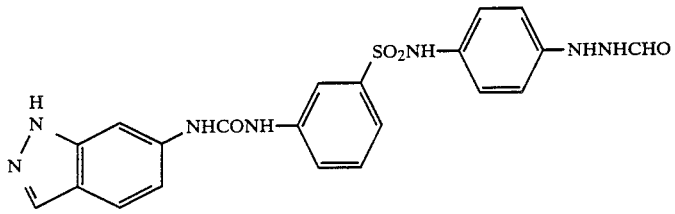
I-32
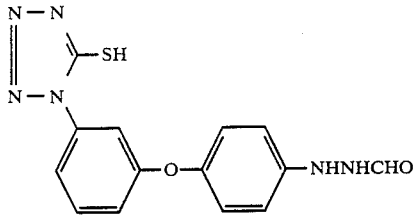
I-33
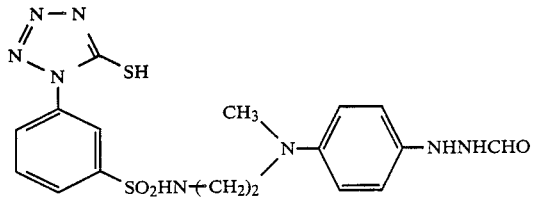
I-34
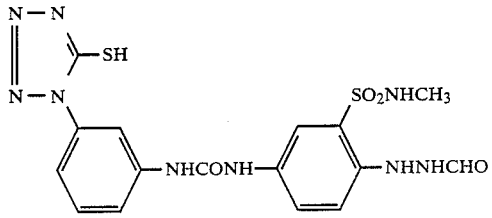
I-35
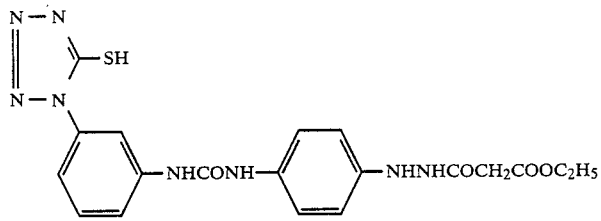
Actual examples of compounds which can be represented by formula (II) are indicated below. However, the invention is not limited to these compounds.
II-1
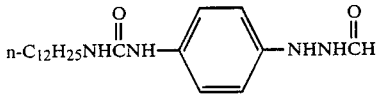
II-2
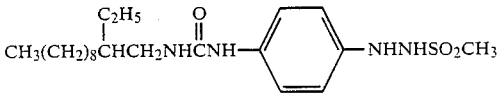
II-3
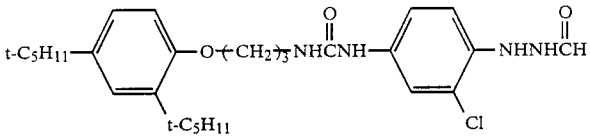

-continued
II-4
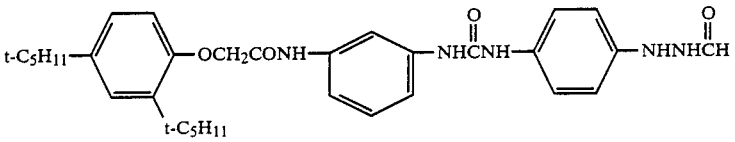
II-5
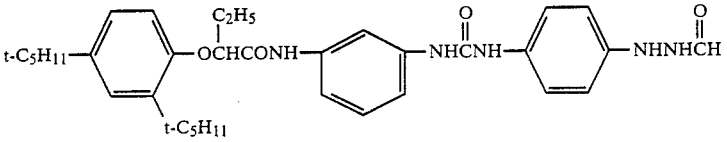
II-6
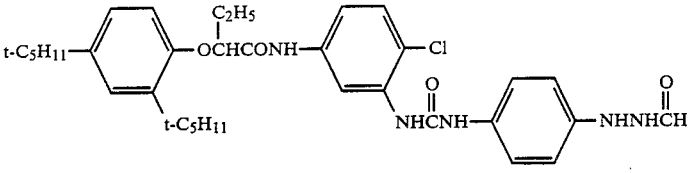
II-7
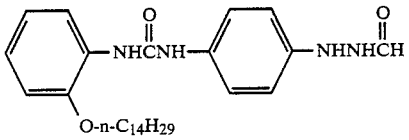
II-8
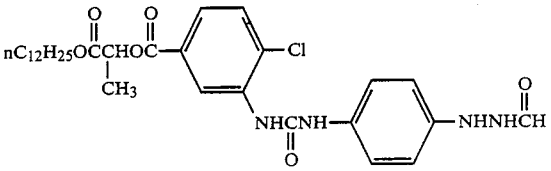
II-9
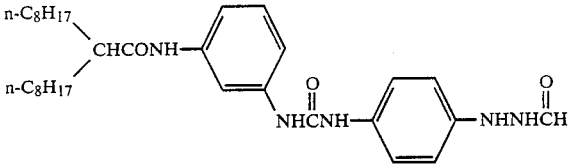
II-10
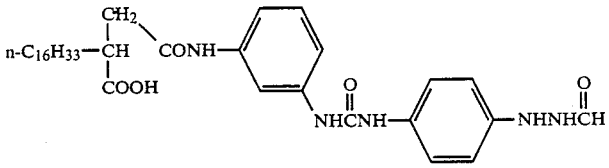
II-11
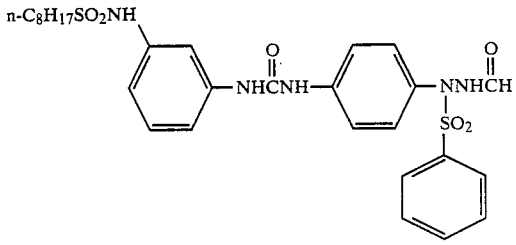
II-12
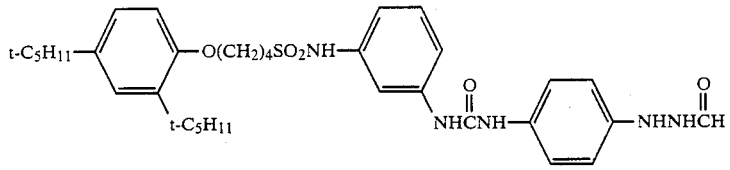

-continued
II-13
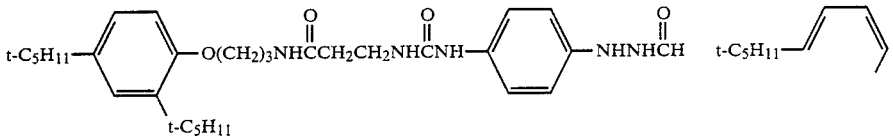
II-14
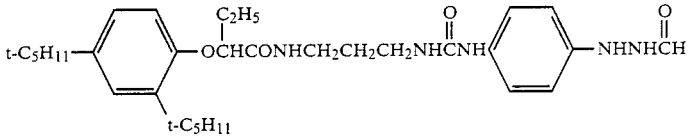
II-15
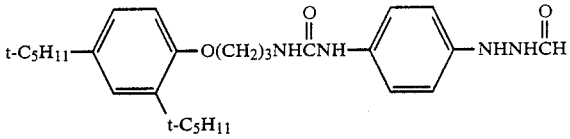
II-16
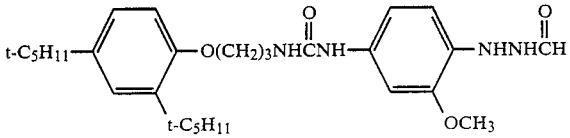
II-17
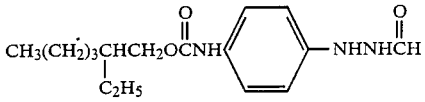
II-18
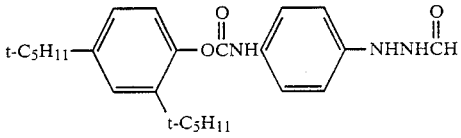
II-19
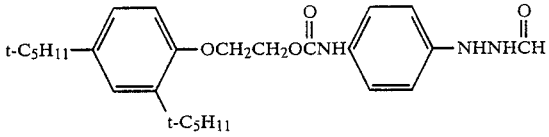
II-20
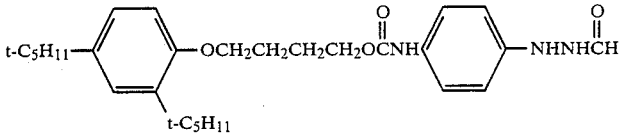
II-21
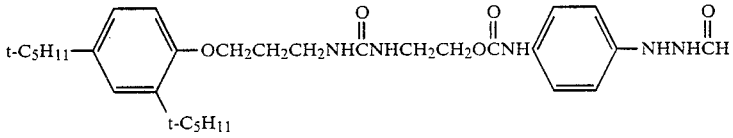
II-22
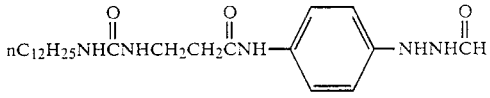
II-23
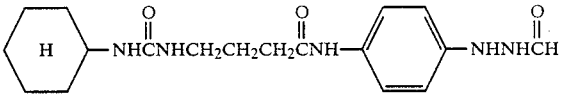

-continued
II-24
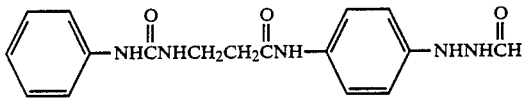
II-25
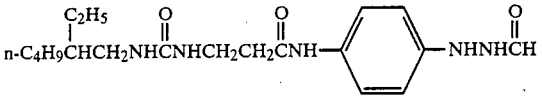
II-26
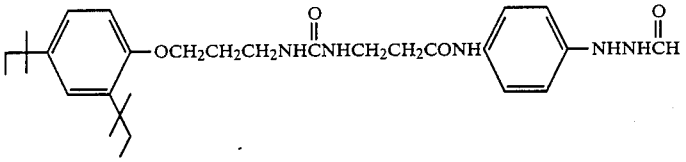
II-27
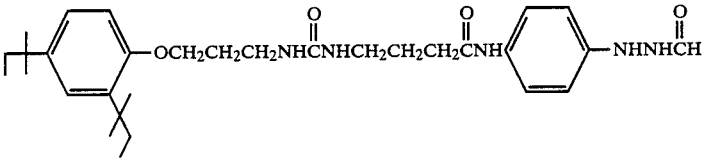
II-28
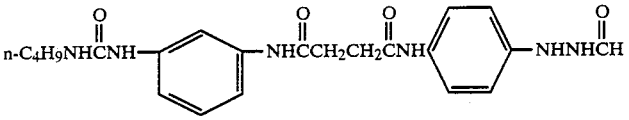
II-29
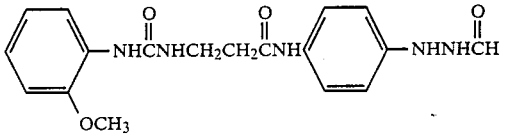
II-30
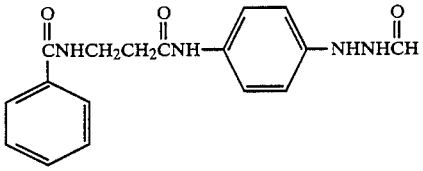
II-31
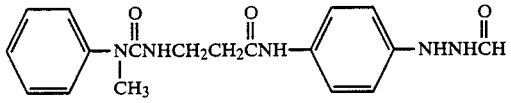
II-32
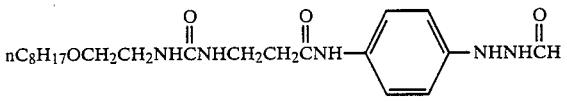
II-33
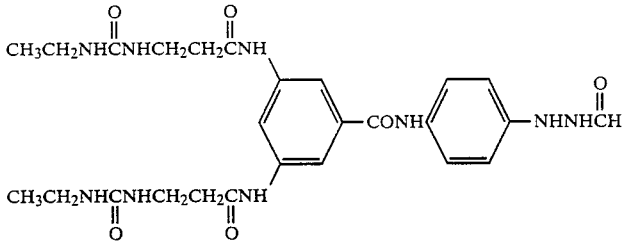

-continued
II-34
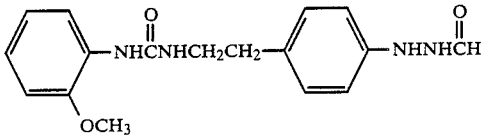
II-35
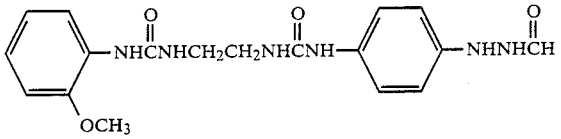
II-36
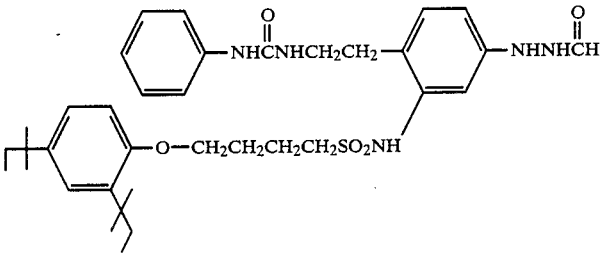
II-37
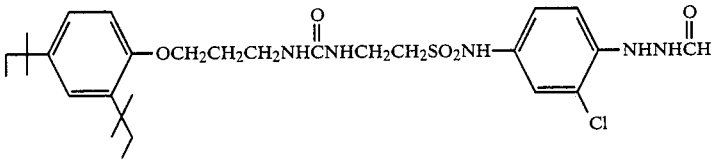
II-38
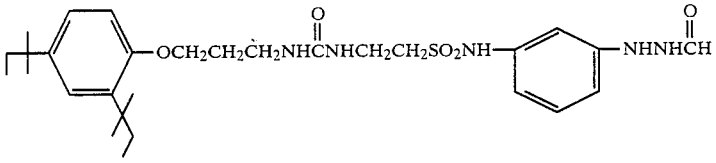
II-39
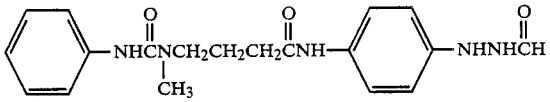
II-40
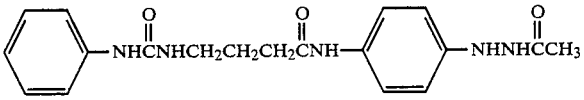
II-41
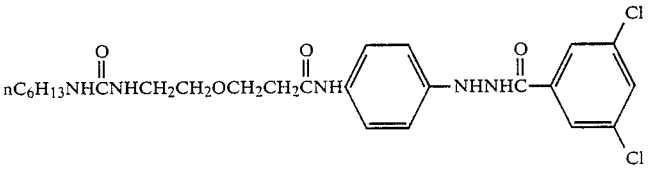
II-42
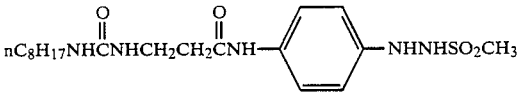

-continued
II-43
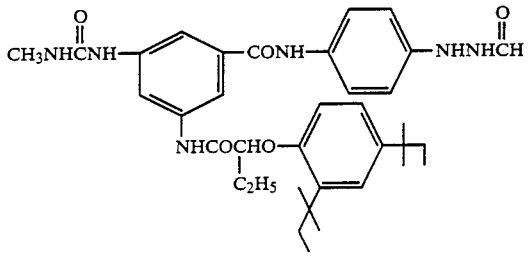
II-44
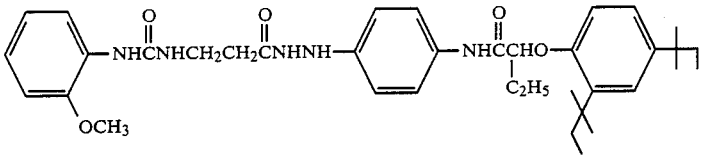
II-45
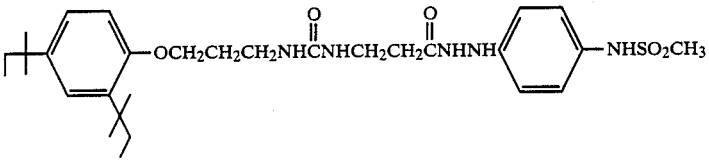
II-46
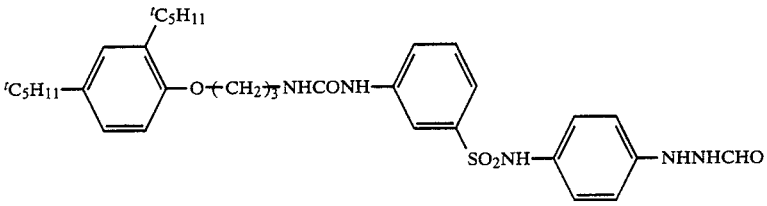
II-47
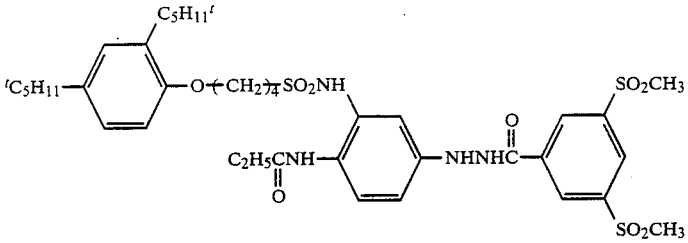
II-48
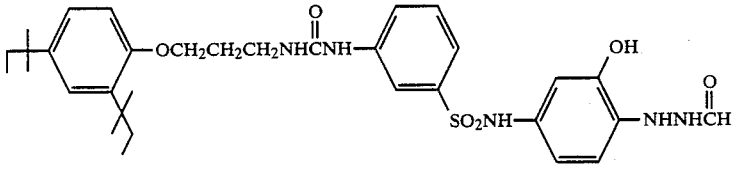
II-49
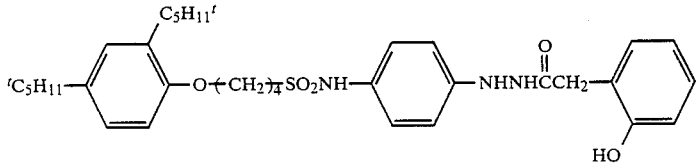
II-50
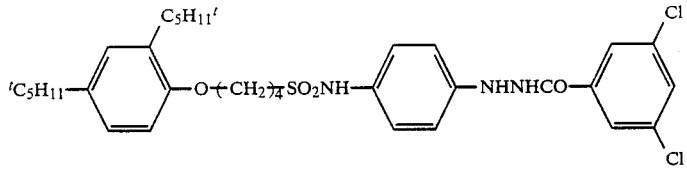

-continued
II-51
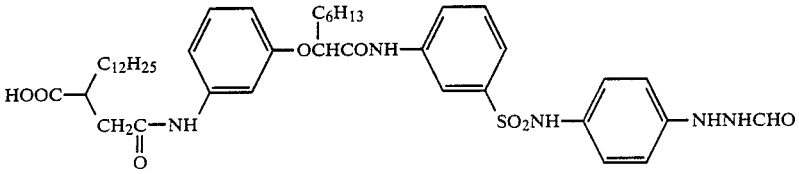
II-52
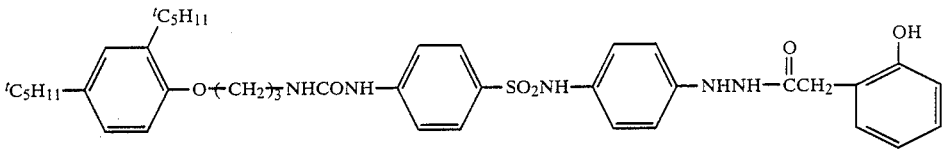
II-53
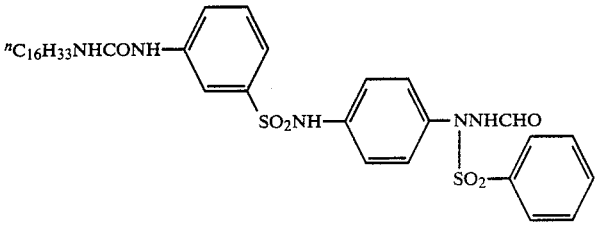
II-54
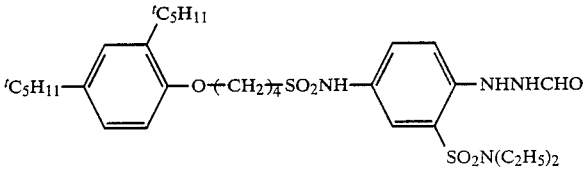
II-55
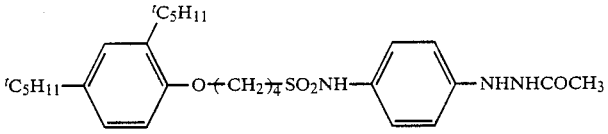
II-56
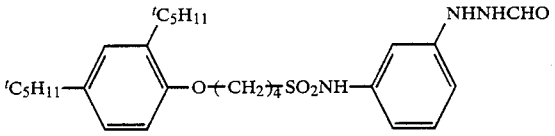
II-57
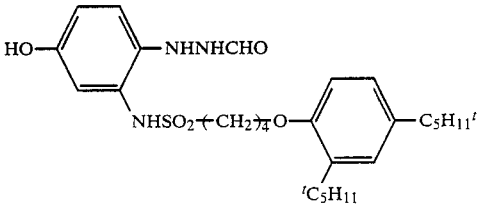
II-58
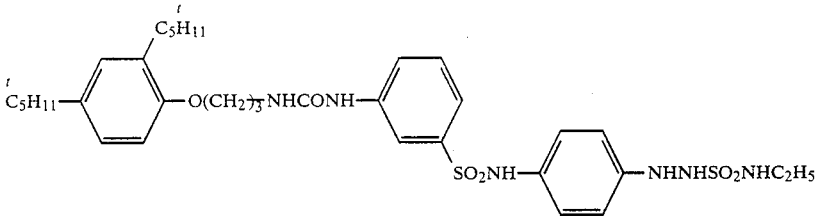

-continued

II-59

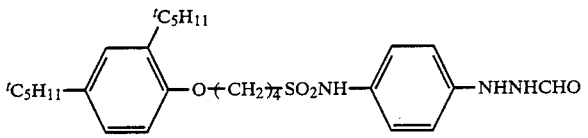

II-60

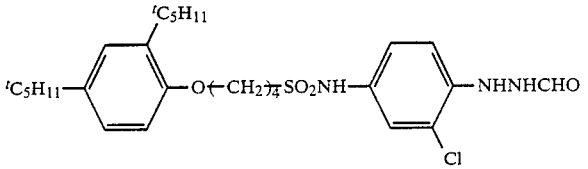

II-61

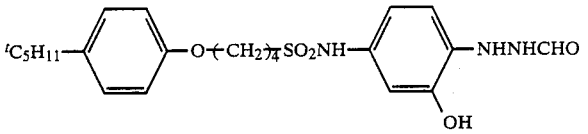

II-62

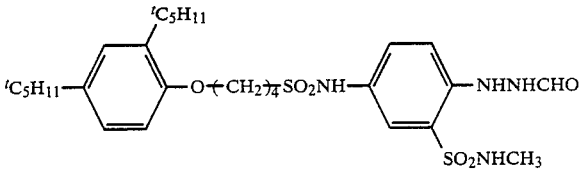

II-63

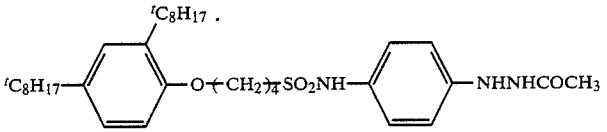

II-64

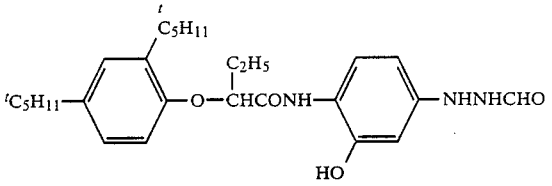

II-65

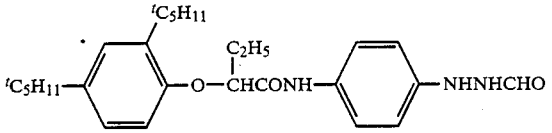

Compounds of formulae (I) and (II) can be prepared in accordance with the methods disclosed in Japanese Patent Application (OPI) Nos. 67843/81, 179734/85, 236548/86 and 270744/86, Japanese Patent Application No. 115036/86, etc.

Actual methods for the synthesis of typical compounds which can be represented by formula (I) are described below.

The following examples are intended to illustrate the present invention in more detail, but not to limit it in any way.

EXAMPLE OF SYNTHESIS 1

Synthesis of Compound I-1

1-(1): Synthesis of 2-[4-(3-Nitrobenzenesulfonamido)-phenyl]-1-formylhydrazine

One liter of N,N-dimethylacetamide, 880 ml of acetonitrile and 285 g of triethylamine were added to 426 g of 2-(4-aminophenyl)-1-formylhydrazine under a nitrogen atmosphere to form a solution and, after cooling to −5° C., 625 g of m-nitrobenzenesulfonyl chloride was added gradually. The mixture was stirred and cooled in such a way that the liquid temperature did not exceed −5° C. during the period. The mixture was then stirred for a further period of 1.5 hours at a temperature of −5° C. or below, after which it was warmed to room temperature and extracted with 12 liters of ethyl acetate and 12 liters of a saturated aqueous solution of sodium chloride. The organic layer was separated off and concentrated to 6 liters, at which time 3 liters of n-hexane was added. The crystals which had formed after stirring the mixture for 30 minutes at room temperature were recovered by filtration and washed with 500 ml of ethyl acetate.

Yield: 680 g; Melting point: 191° to 193° C.

1-(2): Synthesis of 2-[4-(3-Aminobenzenesulfonamido)phenyl]-1-formylhydrazine

Iron powder (680 g), 68 g of ammonium chloride, 6.5 liters of isopropanol and 2.2 liters of water were mixed together and heated with stirring on a steam bath. The nitro compound obtained in (1) above (680 g) was added and the mixture was refluxed for a period of 1.5 hours. The insoluble material was then removed by filtration, the filtrate was concentrated under reduced pressure and water was added. The crystals which formed were recovered by filtration and washed with 1 liter of isopropanol.

Yield: 535 g; Melting point: 155° to 156° C.

1-(3): Synthesis of 2-[4-(3-Phenoxyamidobenzenesulfonamino)phenyl]-1-formylhydrazine The amino compound obtained in (2) above (450 g) was dissolved in 2.8 liters of N,N-dimethylacetamide under a nitrogen atmosphere and then cooled to −5° C. or below. Pyridine (120 ml) was then added, followed by the dropwise addition of 230 g of phenyl chloroformate. The mixture was stirred and cooled in such a way that the temperature did not exceed −5° C. during this time. The reaction mixture was then stirred for a further period of 1 hour at a temperature of −5° C. or below and then it was poured into 20 liters of a saturated aqueous solution of sodium chloride and stirred for a period of 30 minutes. The crystals which formed were recovered by filtration and washed with 2 liters of water.

Yield: 611 g; Melting point: 195° to 197° C.

1-(4): Synthesis of Compound I-1

1-(3-Aminophenyl)-5-mercaptotetrazole hydrochloride·(5.93 g) and 7.03 g of imidazole were dissolved in 30 ml of acetonitrile under a nitrogen atmosphere and the mixture was heated to 65° C. A solution obtained by dissolving 10 g of the urethane compound obtained in (3) above in 58 ml of N,N-dimethylacetamide was added dropwise and the mixture was heated and stirred at a temperature of 65° c for a period of 1.5 hours. After cooling to 30° C, the mixture was extracted with 240 ml of ethyl acetate and 240 ml of water, and the aqueous layer was poured into dilute aqueous hydrochloric acid solution. The crystals which formed were recovered by filtration and washed with water.

Yield: 8.2 g; Melting point: 205° to 207° C (with decomposition)

EXAMPLE OF SYNTHESIS 2

Synthesis of Compound I-3

2-(1): Synthesis of 2-[4-(2-Chloro-5-nitrobenzenesulfonamido)phenyl]-1-formylhydrazine N,N-Dimethylacetamide (90 ml), 76 ml of acetonitrile and 19 ml of pyridine were added to 35.4 g of 2-(4-aminophenyl)-1-formylhydrazine under a nitrogen atmosphere to form a solution. 2-Chloro-5-nitrobenzenesulfonyl chloride (59.9 g) was added gradually after cooling the solution to −5° C. The mixture was stirred and cooled in such a way that the liquid temperature did not exceed −5° C. during this time. The mixture was stirred for a further period of 1.5 hours at a temperature of −5° C. or below and then warmed to room temperature and poured into 1 liter of a saturated aqueous solution of sodium chloride. The crystals which formed were recovered by filtration and washed with water.

Yield: 63 g 2-(2): Synthesis of 2-[4-(5-Amino-2-chlorobenzenesulfonamido)phenyl]-1-formylhydrazine Iron powder (30.1 g), 4.5 g of ammonium chloride, 930 ml of dioxan and 400 ml of water were mixed together and heated with stirring on a steam bath. The nitro compound obtained in (1) above (50 g) was added to this mixture and refluxed for a period of 1.5 hours. The insoluble material was then removed by filtration, the filtrate was concentrated under reduced pressure and extracted with ethyl acetate and a saturated aqueous solution of sodium chloride and the organic layer was concentrated under reduced pressure.

Yield: 43 g, oily material 2-(3): Synthesis of 1-(3-Phenoxyamidophenyl)-5-mercaptotetrazole 1-(3-Aminophenyl)-5-mercaptotetrazole hydrochloride (390.5 g) was dissolved in 800 ml of N,N-dimethylacetamide under a nitrogen atmosphere and. after the dropwise addition of 302 ml of pyridine, the mixture was cooled to below 0° C. and 235 ml of phenylchloroformate was added dropwise. The mixture was stirred and cooled in such a way that the liquid temperature did not exceed 0° C. during this time.

The reaction mixture was stirred for a further period of 30 minutes at a temperature of 0° C. or below and then heated to room temperature and stirred at this temperature for a period of 3 hours. The mixture was then cooled to 10° C., 500 ml of isopropanol and 5 liters of water were added and the mixture was stirred for 1 hour, after which the crystals which had formed were -recovered by filtration and washed with water.

Yield: 495 g; Melting point: 190° to 191° C.

2-(4): Synthesis of Compound I-3

The amino compound obtained in 2-(2) above (6.5 g) and 5.4 g of the urethane compound obtained in 2-(3) above were dissolved in 35 ml of N,N-dimethylacetamide under a nitrogen atmosphere and then 6.1 ml of N-methylmorpholine was added. The mixture was stirred for a period of 7 hours at a temperature of 50° C. and then cooled to room temperature and poured into 330 ml of dilute hydrochloric acid. The crystals which formed were recovered by filtration and washed with water.

Yield: 6.2 g; Melting point: 160° to 165° C. (with decomposition)

EXAMPLE OF SYNTHESIS 3

Synthesis of Compound I-2

3-(1): Synthesis of 2-[4-(4-Chloro-3-nitrobenzenesulfonamino)phenyl]-1-formylhydrazine N,N-dimethylacetamide (90 ml), 76 ml of acetonitrile and 19 ml of pyridine were added to 35.4 g of 2-(4-aminophenyl)-1-formylhydrazine under a nitrogen atmosphere to form a solution. This solution was cooled to a temperature of −5° C. and then 59.9 g of 4-chloro-3-nitrobenzenensulfonyl chloride was added gradually. The mixture was stirred and cooled in such a way that the liquid temperature did not exceed −5° C. during this time. The mixture was then stirred for a further period of 1.5 hours at a temperature of −5° C. or below, after which it was warmed to room temperature and poured into 1 liter of a saturated aqueous solution of sodium chloride. The crystals which formed were recovered by filtration and washed with water.

Yield: 67.5 g 3-(2): Synthesis of 2-[4-(3-Amino-4-chlorobenzenesulfonamido)phenyl]-1-formylhydrazine Iron powder (30.1 g), 4.5 g of ammonium chloride, 930 ml of dioxan and 400 ml of water were mixed together and heated with stirring on a steam bath. The nitro compound obtained in (1) above (50 g) was added to this mixture and refluxed for a period of 1.5 hours. The insoluble material was then removed by filtration and the filtrate was concentrated under reduced pressure, after which water was added, and the crystals which formed were recovered by filtration and washed with 300 ml of isopropanol.

Yield: 44 g 3-(3): Synthesis of Compound I-2

The amino compound obtained in 3-(2) (19.0 g) and 16.2 g of the urethane compound obtained in 2-(3) were dissovled in 105 ml of N,N-dimethylacetamide under a nitrogen atmosphere and then 18.3 ml of N-methylmorpholine was added. The mixture was stirred for 7 hours at a temperature of 60° C. and then cooled to room temperature and poured into 1 liter of dilute hydrochloric acid. The crystals which formed were recovered by filtration and washed with water.

Yield: 13.0 g; Melting point: 153° to 158° C. (with decomposition)

EXAMPLE OF SYNTHESIS 4

Synthesis of Compound I-22

10 ml of N,N-dimethylformamide was added dropwise into a solution of 10 g of sodium 3-(5-mercaptotetrazoyl)phenylsulfonate and 7 ml of thionyl chloride while stirring and water-cooling the mixture, and then the temperature was gradually raised to room temperature and the mixture was stirred for a period of 2 hours. The excess thionyl chloride was removed by distillation under reduced pressure. The residual liquid was poured into ice water, extracted twice with chloroform and on concentration under reduced pressure after drying over anhydrous magnesium sulfate, whereby 3.5 g of 3-(5-mercaptotetrazoyl)phenylsulfonyl chloride was obtained as a colorless oily liquid. Yield 36%.

Next, 1.4 ml of pyridine was added to a solution of 2.2 g of 1-formyl-2-(4-aminophenyl)hydrazine in 10 ml of N,N-dimethylformamide with ice cooling under a nitrogen atmosphere and then 5 ml of acetonitrile containing 3.5 g of 3-(5-mercaptottrazoyl)phenylsulfonyl chloride was added dropwise and the mixture was stirred with ice cooling for a period of 1 hour. The reaction mixture was then poured into an aqueous solution consisting of 100 ml of water and 3 ml of hydrochloric acid and the crystals which precipitated out were recovered by filtration. The crystals obtained were recrystallized from isopropyl alcohol whereupon 4.4 g of 1-{3-[4-(2-formylhydrazino)phenyl]sulfamoyl}phenyl-5-mercaptotetrazole was obtained.

Yield: 77%; Melting point: 192° C. (with decomposition)

Actual methods for the synthesis of compounds which can be represented by formula (II) are described below.

Again, the following examples are intended to illustrate the present invention in more detail but not to limit it in any way.

EXAMPLE OF SYNTHESIS 5

Synthesis of Compound II-4

5-(1): Synthesis of 2-[4-[3-(3-nitrophenyl)ureido]-phenyl]-1-formylhydrazine

Acetonitrile (200 ml) and 200 ml of N,N-dimethylformamide were added to 60.4 g of 2-(4-aminophenyl)-1-formylhydrazine to form a solution and the solution was cooled to −5° C. A solution obtained by dissolving 65.6 g of m-nitrophenylisocyanate in 200 ml of acetonitrile was added dropwise to this solution. The mixture was stirred and cooled in such a way that the temperature did not exceed −5° C. during this time. This was followed by the addition of 300 ml of acetonitrile, and the crystals which had formed after stirring the mixture at 0° C. for 3 hours were recovered by filtration and washed first with acetonitrile and then with methanol. The crystals obtained were dissolved in 1 liter of N,N-dimethylformamide and, after removing the insoluble material by filtration, 3 liters of methanol was added to the filtrate and crystals were formed by cooling. The crystals were recovered by filtration and washed with acetonitrile and then with methanol.

Yield: 98.5 g 5-(2): Synthesis of 2-[4-[3-(3-Aminophenyl)ureido]-phenyl-1-formylhydrazine Iron powder (138 g), 5 g of ammonium chloride, 2.45 liters of dioxan and 985 ml of water were mixed together and heated with stirring on a steam bath. The nitro compound obtained in 1-(1) (98 g) was added to this mixture and refluxed for 40 minutes. The insoluble materials were then removed by filtration and water was added after concentrating the filtrate under reduced pressure. The crystals which formed were recovered by filtration and washed with acetonitrile.

Yield: 79 g 5-(3): Synthesis of Compound II-4

Four grams of the amino compound obtained in 1-(2) was dissolved in 20 ml of N,N-dimethylacetamide, 20 ml of acetonitrile and 1.4 g of triethylamine were added and the mixture was cooled to −5° C. (2,4-di-tert-pentylphenoxy)acetyl chloride (4.4 g) was added dropwise. The mixture was stirred and cooled in such a way that the liquid temperature did not exceed 0° C. during this time. The mixture was then stirred for 1 hour at 0° C. and for a further 2 hours at room temperature and then poured into 800 ml of water, whereupon crystals were precipitated out. The crystals were recovered by filtration and recrystallized from acetonitrile.

Yield: 4.8 g; Melting point: 152° to 154° C.

EXAMPLE OF SYNTHESIS 6

Synthesis of Compound II-5

N,N-Dimethylacetamide (60 ml), 60 ml of acetonitrile and 4.01 g of triethylamine were added to 11.4 g of the amino compound obtained in synthesis example 5-(2), and the mixture was cooled 0° C. 4-(2,4-Di-tert-pentylphenoxy)butyloyl chloride (1.35 g) was added dropwise to this mixture which was being stirred and cooled in such a way that the liquid temperature did not exceed 5° C. during this time. Water was added after stirring for a further period of 1.5 hours and crystals precipitated out. The crystals were recovered by filtration and recrystallized from acetonitrile.

Yield: 11.2 g; Melting point: 207° to 209° C.

EXAMPLE OF SYNTHESIS 7

Synthesis of Compound II-15

N,N-dimethylacetamide (300 ml), 30 ml of triethylamine and 58.3 g of 3-(2,4-di-tert-pentylphenoxy)-propylamine were added to 54.2 g of 2-(4-phenoxycarbonylaminophenyl)-1-formylhydrazine which had been synthesized from phenyl chloroformate and 2-(4-aminophenyl)-1-formylhydrazine, and the mixture was heated and stirred for a period of 1 hour at 60° C. After subsequent cooling to 30° C., the reaction mixture was poured into a mixture consisting of 900 ml of 0.5 mol/liter hydrochloric acid and 700 ml of ethyl acetate. The organic layer was separated and concentrated and then dissolved in 350 ml of acetonitrile. One liter of water was added and the crystals which formed were recovered by filtration and washed with water. The crystals were dissolved in 600 ml of acetonitrile by heating, 3 g of active carbon was added, and the mixture was filtered hot. The filtrate was cooled to room temperature and stirred for 1 hour, then it was ice-cooled and the stirring was continued at an internal temperature of 5° C. The crystals which formed were recovered by filtration and washed with 150 ml of acetonitrile.

Yield: 69.2 g; Melting point: 158° to 160° C.

EXAMPLE OF SYNTHESIS 8

Synthesis of Compound II-26

10 ml of N,N-dimethylacetamide and 0.9 ml of triethylamine were added to 2.5 g of 3-[3-(2,4-di-tert-pentylphenoxy)propylcarbamoylamino]propionic acid, and the mixture was cooled to −15° C. Ethyl chloroformate (0.61 ml) was added dropwise into the mixture in such a way that the liquid temperature did not exceed −5° C. and then the mixture was stirred for 15 minutes at −10° C. Next a solution obtained by dissolving 0.97 g of 2-(4-aminophenyl)-1-formylhydrazine in 7 ml of N,N-dimethylacetamide was added. After stirring for 30 minutes at −30° C. the mixture was stirred for a further period of 30 minutes at room temperature and then poured into an ice-cooled 2% aqueous solution of sodium bicarbonate. The crystals which formed were recovered by filtration, washed with water and subsequently recrystallized from 25 ml of acetonitrile.

Yield: 1.9 g; Melting point: 181.5° C.

EXAMPLE OF SYNTHESIS 9: Synthesis of Compound II-59

2-(4-Aminophenyl)-1-formylhydrazine (2.5 g) was dissolved in 10 ml of N,N-dimethylformamide under a nitrogen atmosphere. Then 2.1 ml of triethylamine was added. The mixture was cooled to −5° C., and a solution obtained by dissolving 5.8 g of 4-(2,4-di-tert-pentylphenoxy)-1-butylsulfonyl chloride in 10 ml of acetonitrile was added dropwise to the mixture. The mixture was stirred and cooled in such a way that the liquid temperature did not exceed 0° C. during this time. The mixture was then stirred for a period of 1 hour at 0° C., after which it was poured into ice water and extracted with ethyl acetate. The organic layer was washed with a saturated aqueous solution of sodium chloride, dried over anhydrous sodium sulfate and filtered, and the filtrate was then concentrated. The concentrate was separated and refined using silica gel column chromatography (eluting solvent: ethyl acetate/chloroform=2/1 (vol/vol)) and the target compound was obtained.

Yield: 2.7 g; Oily material

EXAMPLE OF SYNTHESIS 10

Synthesis of Compound II-46

3-(2,4-Di-tert-pentylphenoxy)-1-propylamine (32 g) and 15 g of imidazole were dissolved in 30 ml of acetonitrile under a nitrogen atmosphere and the mixture was heated to 50° C. A solution obtained by dissolving 42.6 g of the urethane compound obtained in 1-(3) in 40 ml of N,N-dimethylacetamide was added dropwise to the mixture and the resulting mixture was heated and stirred for 1.5 hours at a temperature of 50° C. After cooling to 30° C., the mixture was poured into a mixture consisting of 1 liter of 0.5 mol/liter hydrochloric acid and 1 liter of ethyl acetate. The organic layer was separated and concentrated and then recrystallized from a mixed solvent consisting of ethyl acetate and n-hexane (2/5 vol/vol).

Yield: 33.6 g; Melting point: 118° to 121° C. (softening)

EXAMPLE OF SYNTHESIS 11

Synthesis of Compound II-55

2-(4-Aminophenyl)-1-acetylhydrazine (2.5 g) was dissolved in 10 ml of N,N-dimethylformamide under a nitrogen atmosphere, and then 2.1 ml of triethylamine was added and the mixture was cooled to −5° C. A solution obtained by dissolving 5.8 g of 4-(2,4-di-tert-pentylphenoxy)-1-butylsulfonyl chloride in 10 ml of acetonitrile was added dropwise to the mixture which was stirred and cooled in such a way that the liquid temperature did not exceed 0° C. during this time. The reaction mixture was stirred for a further period of 1 hour at 0° C. and then poured into ice water and extracted with ethyl acetate. The organic layer was washed with a saturated aqueous solution of sodium chloride, dried over anhydrous sodium sulfate and filtered and the filtrate was concentrated. The concentrate was separated and refined by means of silica gel chromatography (eluting solvent: ethyl acetate/chloroform =2/1 (vol/vol)) and the target compound was obtained.

Yield: 3.2 g; Oily material

EXAMPLE OF SYNTHESIS 12

Synthesis of Compound II-56

2-(3-Aminophenyl)-1-formylhydrazine (10.6 g) was dissolved in 30 ml of N,N-dimethylformamide under a nitrogen atmosphere and then 8.2 ml of triethylamine was added and the mixture was cooled to −5° C. A solution obtained by dissolving 11.3 g of 4-(2,4-di-tert-pentylphenoxy)-1-butylsulfonyl chloride in 20 ml of acetonitrile was added dropwise to the mixture which was stirred and cooled in such a way that the liquid temperature did not exceed 0° C. during this time. The reaction mixture was stirred for a further period of 1 hour at 0° C. and then poured into ice water and extracted with ethyl acetate. The organic layer was washed with a saturated aqueous solution of sodium chloride, dried over anhydrous sodium sulfate and filtered and the filtrate was concentrated. The concentrated was separated and refined by means of silica gel chromatography (eluting solvent: ethyl acetate/chloroform=2/1 (vol/vol) and the target compound was obtained.

Yield: 12.2 g; Solid material

EXAMPLE OF SYNTHESIS 13

Synthesis of Compound II-6 13-(1): Synthesis of 1-(2-Chloro-4-nitrophenyl)hydrazine Hydrazine hydrate (59 ml) was dissolved in 712 ml of acetonitrile at room temperature under a nitrogen atmosphere, and a solution obtained by dissolving 46.3 g of 1,2-dichloro-4-nitrobenzene in 71 ml of acetonitrile was added dropwise. After the completion of the addition, the mixture was heated under reflux for a period of 4 hours and then the reaction liquid was concentrated. Next, 500 ml of water was added, and the crystals so obtained were recovered by filtration. 200 ml of acetonitrile was added, and after heating under reflux for 30 minutes the mixture was cooled to room temperature and crystals were recovered by filtration.

Yield: 27 g 13-(2): Synthesis of 2-(2-Chloro-4-nitrophenyl)-1-formylhydrazine

The hydrazine compound obtained in 13-(1) (27 g) as dissolved in 160 ml of acetonitrile under a nitrogen atmosphere and 14 ml of formic acid was added dropwise. The mixture was heated under reflux for a period of 2 hours and then ice-cooled and the crystals which formed were recovered by filtration and washed with acetonitrile.

Yield: 20.3 g 13-(3): Synthesis of 2-(4-Amino-2-chlorophenyl)-1-formylhydrazine

The nitro compound obtained in 13-(2) (19.5 g), 20 g of iron powder, 2 g of ammonium chloride, 400 ml isopropanol and 20 ml of water were mixed together under a nitrogen atmosphere and stirred for 2 hours under reflux on a steam bath. The insoluble material was removed by filtering the hot solution, and the filtrate was concentrated to about 200 ml under reduced pressure and ice-cooled. The crystals formed were recovered by filtration and washed with 200 ml of isopropanol.

Yield: 11.0 g 13-(4): Synthesis of Compound II-60

2-(4-Amino-2-chlorphenyl)-1-formylhylrazine (5.55 g) was dissolved in 30 ml of N,N-dimethylformamide under a nitrogen atmosphere, and 3.03 g of triethylamine was added, followed cooling to −5° C. A solution obtained by dissolving 11.8 g of 4-(2,4-di-tert-pentylphenoxy)-1-butylsulfonyl chloride in 10 ml of acetonitrile was added dropwise to the mixture which was stirred and cooled in such a way that the liquid temperature did not exceed 0° C. during this time. The mixture was stirred for a further period of 1 hour at 0° C. and then poured into ice water and extracted with ethyl acetate. The organic layer was washed with a saturated aqueous solution of sodium chloride, dried over anhydrous sodium sulfate and filtered, and the filtrate was concentrated. The concentrate was separated and refined by silica gel column chromatography (eluting solvent: ethyl acetate/chloroform=½ (vol/vol), and the target compound was obtained.

Yield: 7.0 g; Melting point: 157° to 159° C.

EXAMPLE OF SYNTHESIS 14

Synthesis of Compound II-54

14-(1): Synthesis of 2-Chloro-1-diethylsulfamoyl-5-nitrobenzene

2-Chloro-5-nitrophenylsulfonyl chloride (7.6 g) was dissolved in 50 ml of acetone and then cooled to −10° C., and a solution obtained by dissolving 3.03 g of triethylamine and 2.2 g of diethylamine in 20 ml of acetonitrile was added dropwise. The mixture was stirred and cooled in such a way that the liquid temperature did not exceed 0° C. during this time. The temperature was then raised gradually to room temperature and the mixture was poured into aqueous diluted hydrochloric acid of pH about 2. The crystals which formed were recovered by filtration and washed with water.

Yield: 7.8 g 14-(2): Synthesis of 1-(2-Diethylsulfamoyl-4-nitrophenyl)hydrazine

The chloro derivative obtained in 14-(1) above was dissolved in 90 ml of methanol and heated under reflux and a solution obtained by dissolving 6.2 g of hydrazine hydrate in 30 ml of ethanol was added dropwise. The reaction mixture was concentrated after refluxing for a period of 4 hours and the target compound was obtained.

Yield: 7.8 g 14-(3): Synthesis of 2-(2-Diethylsulfamoyl-4-nitrophenyl)-1-formylhydrazine The hydrazine compound obtained in 14-(2) (5 g) was dissolved in 25 ml of acetonitrile under a nitrogen atmosphere and 2 ml of formic acid was added dropwise. The mixture was then heated under reflux for a period of 5 hours, after which it was concentrated under reduced pressure, 100 ml of water was added and the mixture was stirred for 1 hour at room temperature. The crystals which formed were recovered by filtration and recrystallized from ethanol.

Yield: 4.0 g 14-(4): Synthesis of 2-(4-Amino-2-diethylsulfamoylphenyl)1-formylhydrazine The nitro compound obtained in 14-(3) (10 g) was dissolved in 210 ml of ethanol and 90 ml of water under a nitrogen atmosphere, and a solution obtained by dissolving 27 g of hydrosulfite is 120 ml of water was added dropwise. The mixture was stirred at room temperature for a period of 30 minutes and then at a temperature of 60° C. for a period of 15 minutes. The insoluble material was removed by filtration, and the filtrate was concentrated under reduced pressure. 100 ml of water was then added thereto, and the crystals which formed were recovered by filtration and recrystallized from ethanol.

Yield: 3.7 g 14-(5): Synthesis of Compound II-54

The amino compound obtained in 14-(4) (1.7 g) was dissolved in 17 ml of acetonitrile under a nitrogen atmosphere and heated under reflux, and a solution obtained by dissolving 2.8 g of 4-(2,4-di-tert-pentylphenoxy)-1-butylsulfonyl chloride in 2.8 ml of acetonitrile was added dropwise. The mixture was refluxed with heating for a further period of 1 hour and then poured into 200 ml of water. The supernatant layer was removed and the mixture solidified on adding n-hexane. The supernatant n-hexane was removed and the target compound was obtained by washing the solid with ether.

Yield: 1.4 g; Melting point: 169° to 171° C.

In this invention the compounds which can be represented by the formulae (I) and (II) are preferably included in the silver halide emulsion layer when they are used in photographic materials but they may be included in other, non-photosensitive, hydrophilic colloid layers (for example, in protective layers, intermediate layers, filter layers, anti-halation layers, etc.). In practice the compounds which are used are formed into an aqueous solution if they are water-soluble, or into a solution in water miscible organic solvents such as alcohols, esters, ketones, etc. if they are only sparingly soluble in water and they are added to the hydrophilic colloid solution in such a form. When the compounds are added to a silver halide emulsion layer, the addition can be made at any time during the interval from the commencement of chemical ripening to before coating, but the addition is preferably made during the interval from the completion of chemical ripening to before coating. The compounds are best added to the coating liquid which is ready for coating.

The optimum amounts of the compounds which can be represented by the formulae (I) and (II) of this invention are preferably selected in accordance with the grain size of the silver halide emulsion, the halide composition, the method used for chemical sensitization and the extent of such sensitization, the relationship between the layer in which the said compounds are included and the silver halide emulsion layer, and the type of anti-fogging compounds which are being used, etc., and the test methods which may be used for making such a selection are well known to those in the industry. Normally the preferred quantity is from $10^{-6}$ mol to $1\times10^{-1}$ mol per mol of silver halide, and the use of the compounds of formula (I) at a rate of from $1\times10^{-5}$ to $1\times10^{-2}$ mol per mol of silver halide and the compounds of formula (II) at a rate of from $1\times10^{-4}$ to $4\times10^{-2}$ mol per mol of silver halide is preferred. The compounds of formula (I) and the compounds of formula (II) need not be added to the same layer.

The silver halide emulsions to which the invention can be applied may be composed of silver chloride, silver chlorobromide, silver iodobromide, silver iodochlorobromide, etc., but in the cases of materials for reversal processing, a silver halide emulsion which contains at least 60 mol %, and preferably at least 75 mol %, of silver chloride is preferred. Silver chlorobromides or silver chloroiodobromides which contain 0 to 5 mol % of silver bromide are preferred.

In the case of sensitive materials used for screening purposes, a silver halide consisting of at least 70 mol % and preferably of at least 90 mol % silver bromide is preferred. A silver iodide content of not more than 10 mol %, and preferably of 0.1 to 5 mol % is preferred.

The average grain size of the silver halide used in the invention is preferably small (for example, less than $0.7\mu$) and an average grain size of not more than $0.5\mu$ is most desirable. Basically, no limitation is imposed on the grain size distribution but mono-dispersions are preferred. In this context, a mono-dispersion consists of grains of which at least 95% in terms of weight or numbers of grains are of a size within 40% of the average grain size.

The silver halide grains in the photographic emulsion may have a regular crystal form such as a cubic or octahedral form or they may have an irregular crystal form such as a spherical or plate-like form, or alternatively they may have a complex crystalline form consisting of these forms. The cubic form is especially desirable.

The silver halide grains may be such that the interior and surface parts consist of a uniform phase, or the interior and surface parts may consist of different phases. Moreover, two or more types of silver halide emulsion which have been prepared separately can be used in the form of a mixture.

Cadmium salts, sulfites, lead salts, thallium salts, rhodium salts or complex salts thereof, iridium salts or complex salts thereof, etc. may be introduced during the formation or physical ripening of the silver halide grains into the silver halide emulsions which are used in this invention.

Rhodium monochloride, rhodium dichloride, rhodium trichloride, ammonium hexachlororhodinate, etc. can be used as the rhodium salt, but the water soluble halogen complexes of trivalent rhodium, such as hexachlororhodium (III) acid or its salts (ammonium, sodium, potassium salt, etc.) are preferred.

These water soluble rhodium salts are used in an amount within the range from $1.0\times10^{-8}$ mol to $1.0\times10^{-3}$ mol, and preferably within the range from $1.0\times10^{-7}$ to $5.0\times10^{-4}$ mol, per mol of silver halide.

The silver halide emulsion which is used in the method of this invention may or may not be chemically sensitized. Known methods for the chemical sensitization of silver halide emulsions include sulfur sensitization, reduction sensitization and noble metal sensitization, and chemical sensitization can be carried out using any of these methods individually or jointly.

The gold sensitization method is typical of the noble metal sensitization methods and gold salts, principally gold complex salts, are used for this purpose. Complex salts of noble metals other than gold, for example, complex salt of platinum, palladium, iridium, etc., can also be included. Actual examples have been disclosed in U.S. Pat. No. 2,448,060 and British Patent No. 618,061, etc.

Various sulfur compounds, for example, thiosulfates, thioureas, thiazoles, rhodanines, etc. can be used as well as the sulfur compounds which are included in the gelatin as sulfur sensitizing agents. Stannous salts, amines, formamidinesulfinic acid, silane compounds, etc. can be used as reducing sensitizing agents.

Spectrally sensitizing dyes may be added to the silver halide emulsion layers which are used in the invention. The spectrally sensitizing dyes include useful sensitizing dyes, combinations of dyes which exhibit super sensitization and substances which exhibit super sensitization, these being disclosed in subsection "J" of section IV on page 23 of *Research Disclosure,* Vol. 176, No. 17643 (published December, 1978).

The use of gelatin as a binder or protective colloid is advantageous in photographic emulsions, but other hydrophilic colloids can also be used for this purpose. For example, use can be made of gelatin derivatives, graft polymers of gelatin and other polymeric materials, proteins such as albumin, casein, etc., cellulose derivatives such as hydroxyethylcellulose, carboxymethylcellulose, cellulose sulfate esters, etc., sodium alginate, sugar derivatives such as starch derivatives, etc., and various synthetic hydrophilic polymeric materials such as the homopolymers poly(vinyl alcohol), partially acetalated poly(vinyl alcohol), poly-N-vinylpyrrolidone, poly(acrylic acid), poly(methacrylic acid), polyacrylamide, polyvinyl-imidazole, polyvinylpyrazole, etc. or copolymers thereof.

Acid treated gelatin and gelatin hydrolyzates and enzyme degradation products of gelatin can also be used for the gelatin as well as lime treated gelatin.

Various compounds can be included in the photosensitive materials of this invention with a view to preventing the occurrence of fogging during the manufacture, storage or processing of the photosensitive material or to improve photographic performance. Thus, many compounds which are known as anti-foggants and stabilizing agents, including the azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketone compounds such as oxazolinthione, for example; azaindenes, for example, triazaindenes, tetra-azaindenes (especially 4-hydroxy substituted (1,3,3a,7)tetraazaindenes), pentaazaindenes, etc.; hydroquinone and derivatives thereof; disulfides, for example, thioctic acid; benzenethiosulfonic acid, benzenesulfinic acid, benzenesulfonic acid amide, etc. can be used. Of these compounds, the benzotriazoles (for example, 5-methylbenzotriazole) and the nitroindazoles (for example, 5nitroindazole) are preferred. These compounds may also be included in the processing baths.

The photosensitive materials of this invention may also contain organic desensitizing agents. The preferred organic desensitizing agents have at least one water soluble group or alkali dissociable group.

These preferred organic desensitizing agents have been described in Japanese Patent Application No. 209169/86. When used, the organic desensitizing agents are included in the silver halide emulsion layer at a rate of from $1.0\times10^{-8}$ to $1.0\times10^{-4}$ mol/m$^2$, and preferably at a rate of from $1.0\times10^{-7}$ to $1.0\times10^{-5}$ mol/m$^2$.

The photosensitive materials of this invention may contain development accelerating agents. Apart from the compounds disclosed in Japanese Patent Application (OPI) Nos. 77616/78, 37732/79, 137133/78, 140340/85 and 14959/85, etc., a variety of compounds which contain a nitrogen or a sulfur atom are effective as development accelerating agents or agents for accelerating nucleation infectious development, and are also suitable for use in this invention.

Typical examples are indicated below.

(1)

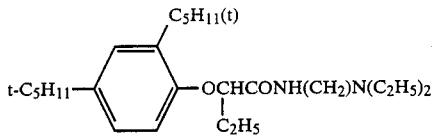

(2)

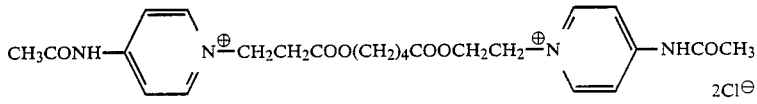

(3)

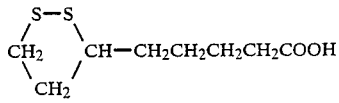

(4)

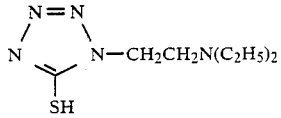

(5)

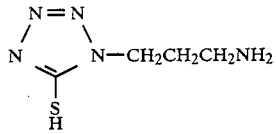

(6)

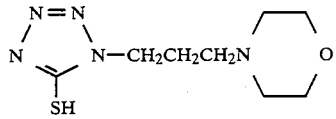

(7)

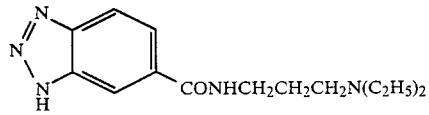

(8)

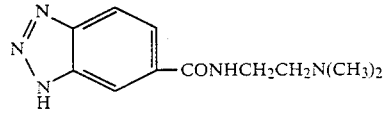

(9)

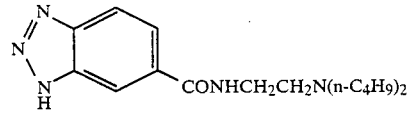

-continued (10)

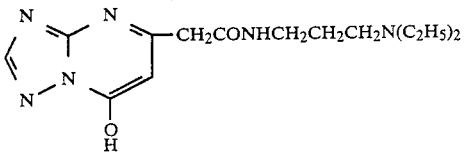

(11)

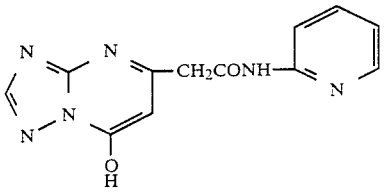

(12)

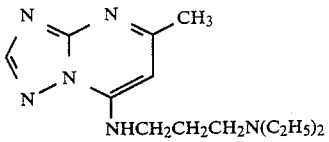

(13)

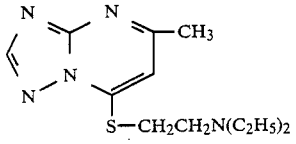

(14)

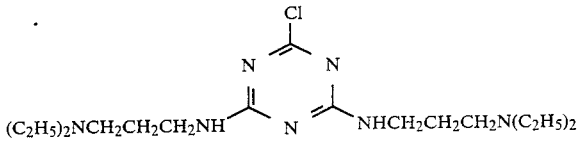

(15)

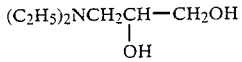

(16)

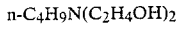

(17)

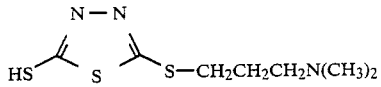

The optimum amounts of these accelerators differ according to the type of compound, but the use of an amount within the range from $1.0\times10^{-3}$ to 0.5 g/m$^2$, and preferably within the range from $5.0\times10^{-3}$ to 0.1 g/m$^2$ is desirable. These accelerators can be dissolved in a suitable solvent (water, an alcohol such as methanol or ethanol, etc., acetone, dimethylformamide, methylcellosolve, etc.) and added to the coating liquid.

A number of types of these additives may be used jointly.

Water soluble dyes may be included in the emulsion layers or other hydrophilic colloid layers in this invention as filter dyes or for the prevention of irradiation or for a variety of other purposes. Dyes for reducing the photographic sensitivity can be used, and the use of ultraviolet absorbers which have a spectral absorption maximum in the intrinsic sensitivity region of the silver halide, and dyes which essentially absorb light in the region from 310 nm to 600 nm for raising the stability to safe-lights as filter dyes are preferred.

These dyes may be added to the emulsion layer, or they may be added together with mordants and fixed in the top part of the silver halide emulsion layer, which is to say in a non-photosensitive hydrophilic colloid layer which is located farther from the support than the silver halide emulsion layer, depending on its intended purpose.

The amount of dye used differs according to the molar extinction coefficient of the dye, but an amount within the range from $10^{-3}$ to 1 g/m$^2$ is normally used. An amount within the range from 10 to 500 mg/m$^2$ is preferred.

The above mentioned dyes can be dissolved in a suitable solvent [for example, water, alcohol (for example, methanol, ethanol, propanol, etc.), acetone, methylcellosolve, etc. or mixtures of these solvents] and added to the coating liquid.

Combinations of two or more of these dyes can also be used.

Actual examples of these dyes have been disclosed in Japanese Patent Application No. 209169/86.

The ultraviolet absorbing dyes disclosed in U.S. Pat. Nos. 3,533,794, 3,314,794 and 3,352,681, Japanese Patent Application (OPI) No. 2784/71, U.S. Pat. Nos. 3,705,805, 3,707,375, 4,045,229, 3,700,455 and 3,499,762 and in West German Patent Application No. 1,547,863, etc., can also be used.

The pyrazoloneoxonol dyes disclosed in U.S. Pat. No. 2,274,782, the diarylazo dyes disclosed in U.S. Pat. No. 2,956,879, the styryl dyes and butadienyl dyes disclosed in U.S. Pat. Nos. 3,423,207 and 3,384,487, the merocyanine dyes disclosed in U.S. Pat. No. 2,527,583, the merocyanine dyes and oxonol dyes disclosed in U.S. Pat. Nos. 3,486,897, 3,652,284 and 3,718,472, the enaminohemioxonol dyes disclosed in U.S. Pat. No. 3,976,661 and the dyes disclosed in British Patents Nos. 584,609 and 1,177,429, Japanese Patent Application (OPI) Nos. 85130/73, 99620/74 and 114420/74 and in U.S. Pat. Nos. 2,533,472, 3,148,187, 3,177,078, 3,247,127, 3,540,887, 3,575,704 and 3,653,905 can also be used.

Inorganic or organic film hardening agents may be included in the photographic emulsion layers and other hydrophilic colloid layers in the photosensitive materials of this invention. For example, chromium salts (chrome alum, chromium acetate, etc.), aldehydes (for example, formaldehyde, glyoxal, glutaraldehyde, etc.), N-methylol compounds (dimethylolurea, methyloldimethylhydantoin, etc.), dioxan derivatives (2,3-dihydroxydioxan, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), epoxy compounds (tetramethyleneglycol diglycidyl ether, etc.), isocyanate compounds (hexamethylene diisocyanate, etc.), etc. may be used individually or in combinations for this purpose.

Furthermore, the polymeric film hardening agents disclosed in Japanese Patent Application (OPI) No. 66841/81, British Patent No. 1,322,971 and U.S. Pat. No. 3,671,256 can also be used.

Various surfactants can also be included in the photographic emulsion layers or other hydrophilic colloid layers of the photosensitive materials prepared in accordance with this invention as coating aid or with a view to preventing the build up of electrostatic charge, improving slip properties, for emulsification and dispersion purposes, for the prevention of sticking or improving the photographic performance (for example, accelerating development, changing contrast, sensitization) of the photosensitive material, etc.

For example, use can be made of non-ionic surfactants such as saponin (steroid based), alkyleneoxide derivatives (for example, poly(ethylene glycol), poly(ethylene glycol)/poly(propylene glycol) condensates, poly(ethylene glycol) alkyl ethers, or poly(ethylene glycol) alkyl aryl ethers, poly(ethylene glycol) esters, poly(ethylene glycol) sorbitane esters, poly(alkylene glycol) alkylamines or amides, polyethyleneoxide adducts of silicones, etc.), glycidol derivatives (for example, alkenylsuccinic acid polyglyceride, alkylphenol polyglyceride), fatty acid esters of polyvalent alcohols, alkyl esters of sugars, etc.; anionic surfactants which contain acidic groups such as carboxyl groups, sulfo groups, phospho groups, sulfate ester groups, phosphate ester groups, etc., such as alkylcarboxylates, alkylsulfonates, alkylbenzenesulfonates, alkylnaphthalenesulfonates, alkyl sulfate esters, alkyl phosphate esters, N-acyl-N-alkyltaurines, sulfosuccinate esters, sulfoalkyl polyoxyethylenealkylphenylethers, polyoxyethylenealkyl phosphate esters, etc.; amphoteric surfactants such as amino acids, aminoalkylsulfonic acids, aminoalkyl sulfate or phosphate esters, alkylbetaines, amineoxides, etc.; and cationic surfactants such as the alkylamine salts, aliphatic and aromatic quaternary ammonium salts, heterocyclic quaternary ammonium salts such as pyridinium and imidazolium salts and phosphonium or sulfonium salts which contain an aliphatic or heterocyclic ring.

The use of the polyalkyleneoxides having minimum molecular weight of 600 (disclosed in Japanese Patent Publication No. 9,412/83) as a surfactant is especially desirable in this invention. Furthermore, a polymer latex such as a poly(alkyl acrylate) latex can be included to provide dimensional stability.

It is not necessary to use the conventional infectious development baths or the highly alkaline development baths of pH approaching 13 (disclosed in U.S. Pat. No. 2,419,975). Stable development baths can be used to obtain photographic characteristics of ultra-high contrast using the silver halide photosensitive materials of this invention.

Thus negative images of a sufficiently ultra-high contrast can be obtained using a development bath of pH 10.5 to 12.3, especially one of pH 11.0 to 12.0, which contains 0.15 mol/liter or above of sulfite ion as a preservative with the silver halide photosensitive materials of this invention.

No particular limitation is imposed upon the developing agents which can be used in the method of this invention and, for example, dihydroxybenzenes (for example, hydroquinone), 3-pyrazolidones (for example, 1-phenyl-3-pyrazolidone, 4,4-dimethyl-1-phenyl-3-pyrazolidone) and aminophenols (for example, N-methyl-p-aminophenol), etc. can be used individually or in combination for this purpose.

The silver halide photosensitive materials of this invention are ideal for processing in development baths which contain dihydroxybenzenes as the main developing agent and 3-pyrazolidones or aminophenols as secondary developing agents. In the preferred development baths dihydroxybenzenes are used at a concentration of 0.05 to 0.5 mol/liter jointly with 3-pyrazolidones or aminophenols at a concentration with the range below 0.06 mol/liter.

It is possible to increase the development rate and reduce the development time by adding amines to the development bath, as disclosed in U.S. Pat. No. 4,269,929.

pH buffers such as alkali metal sulfites, carbonates, borates and phosphates, and development inhibitors and anti-foggants such as bromides, iodides and organic anti-foggants (most desirably the nitroindazoles or benzotriazoles, etc.) can be included in the development bath. Hard water softening agents, dissolution promotors, toners, development accelerators, surfactants (the aforementioned polyalkyleneoxides are especially desirable), anti-foaming agents, film hardening agents and agents for preventing silver contamination of the film (for example, 2-mercaptobenzimidazolesulfonic acids, etc.) may also be included as required.

The generally used compositions can be used for the fixing bath. The organic sulfur compounds which are known to be effective as fixing agents can be used as well as the thiosulfates and thiocyanates. Water soluble aluminum salts may be included in the fixing bath as film hardening agents.

A processing temperature between 18° C. and 50° C. is usually selected in the method of this invention.

The use of an automatic developing machine is preferred for photo-processing, and with the method of this invention, photographic characteristics which have a satisfactory negative gradation in terms of ultra-high contrast can be obtained even when the overall processing time from the insertion of the photo-sensitive material into the automatic developing machine to the time at which it emerges from the machine is set at 90 to 120 seconds.

The compounds disclosed in Japanese Patent Application (OPI) No. 24347/81 can be used in the development baths of this invention as agents for preventing silver contamination. The compounds disclosed in Japanese Patent Application (OPI) No. 267756/86 can be used as dissolution aid which are added to the development bath. Moreover, the compounds disclosed in Japanese Patent Application (OPI) No. 93433/85 or the compounds disclosed in Japanese Patent Application (OPI) No. 186259/87 can be used as the pH buffers which are used in the development baths.

The invention is described below by means of examples. A development bath of which the formula is indicated below was used in the examples.

| Development Bath | |
|---|---|
| Hydroquinone | 45.0 g |
| N-Methyl-p-aminophenol, hemisulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Ethylenediamine tetra-acetic acid di-sodium salt | 1.0 g |
| Potassium bromide | 6.0 g |
| 5-Methylbenzotriazole | 0.6 g |
| n-Butyldiethanolamine | 15.0 g |
| Water to make | 1 liter (pH = 11.6) |

EXAMPLE 1

An aqueous solution of silver nitrate and an aqueous solution of sodium chloride were mixed simultaneously in an aqueous gelatin solution which was being maintained at 40° C. in the presence of $5.0\times10^{-6}$ mol of $NH_4RhCl_6$ per mol of silver, and after removing soluble salts using the methods well known in the industry, gelatin was added and 2-methyl-4-hydroxy-1,3,3a,7-tetraazaindene (stabilizer) was added without chemical ripening. This emulsion was a mono-disperse emulsion consisting of cubic crystals of average grain size 0.2 μm.

The selected hydrazine compounds of formulae (I) and (II) shown in Table 1 were added in the quantities shown in Table 1 to this emulsion, and the compound of which the formula is indicated below was added as a nucleation accelerator at a rate of 15 mg/m$^2$.

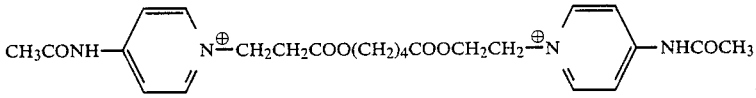

Moreover, poly(ethyl acrylate) latex was added at a rate of 30 wt % of the gelatin in terms of solid fraction, 1,3-vinylsulfonyl-2-propanol was added as a film hardening agent, and the resulting liquid was coated so as to provide a coated silver weight of 3.8 g/m$^2$ on a polyester support. The gelatin was coated at a rate of 1.8 g/m$^2$. This was coated over with a layer consisting of 1.5 g/m$^2$ of gelatin and 0.3 g/m$^2$ of poly(methyl methacrylate) of grain size 1.5μ as a protective layer.

1. Evaluation of Photographic Characteristics

The samples were exposed through an optical wedge in Printer p-607 made by the Dainippon Screen Co. and the samples were subjected to a 30 second development at 38° C. and then fixed, washed and dried.

The results obtained in respect of photographic characteristics were as shown in Table 1.

The samples of this invention had a higher image density (Dmax) than the comparative example samples. Furthermore, the gradation showed a higher contrast relative to comparative example samples 1-d to 1-g in which only compounds of formula (II) had been used.

2. Evaluation of Physical Properties of the Film (Measurement of Wet Film Strength)

The above mentioned coated samples were immersed in a development bath at 38° C. for a period of 20 seconds and the strength when the surface of the still wet sample was scratched with a stainless steel needle of diameter 0.5 mm under various loads was measured. The evaluation was based on the load at which scratches started to appear, and this value is shown in Table 1.

When the compounds of formula (II) were added to enhance contrast, the wet firm strength was remarkably reduced. All of the samples of this invention displayed high film strength.

3. Evaluation of the Ease of Reduction

A mesh screen with a dot area factor of 50% was placed on the above mentioned samples, and developed films with a screen image were obtained by processing under the conditions described in the section relating to the evaluation of the photographic characteristics above. The percentage reduction (reduction value) which could be achieved in the parts where the screen area factor of the developed films was 50% was investigated using the reducing solution described below. The reduction value is indicated as the reduction of the dot area factor when the dot density was bleached to 2.5, and a large reduction value is preferred since the range over which the dot area can be adjusted by the reduction treatment is expanded. The Fe-EDTA reducing solution indicated below was used for reducing.

| | |
|---|---|
| Ethylenediamine tetra-acetic acid iron (III) sodium salt | 85 g |
| Thiourea | 65 g |
| Citric acid | 60 g |
| Hydrochloric acid (to adjust to pH 1.0) | |
| Water | to make up to 1 liter |

These results were such that the comparative examples 1-a to 1-c had a small reduction value at 10 to 11% while all of samples 1-1 to 1-8 of this invention gave a high value of 18 to 19%.

4. Overall Evaluation

When the test results obtained in Sections 1 to 3 above are looked at overall, it is clear that the samples of this invention were superior in performance in all cases.

TABLE 1

| Sample No. | Compound of Formula (I) Type | Amount (mg/m²) | Compound of Formula (II) Type | Amount (mg/m²) | Photographic Characteristics Sensitivity* | Dmax** | Gradation*** (gamma) | Wet Film Strength (g) |
|---|---|---|---|---|---|---|---|---|
| Comp. Ex. | | | | | | | | |
| 1-a | Compound (I-1) | 8.0 | — | — | 0 | 3.25 | 25.0 | 120 |
| 1-b | (I-20) | 12.0 | — | — | −0.03 | 3.48 | 23.5 | 116 |
| 1-c | (I-21) | 10.0 | — | — | −0.05 | 3.12 | 20.7 | 116 |
| 1-d | — | — | Compound (II-15) | 74 | 0.02 | 4.05 | 16.4 | 65 |
| 1-e | — | — | (II-65) | 62 | 0.00 | 3.88 | 10.5 | 73 |
| 1-f | — | — | (II-15) | 15 | −0.08 | 2.67 | 5.3 | 115 |
| 1-g | — | — | (II-65) | 13 | −0.12 | 2.43 | 5.1 | 120 |
| The Invention | | | | | | | | |
| 1-1 | (I-1) | 5.0 | (II-15) | 15 | ±0.0 | 5.60 | 27.0 | 115 |
| 1-2 | (I-1) | 5.0 | (II-65) | 13 | ±0.0 | 5.05 | 25.5 | 115 |
| 1-3 | (I-20) | 6.0 | (II-15) | 15 | −0.02 | 5.50 | 25.3 | 110 |
| 1-4 | (I-20) | 6.0 | (II-65) | 13 | −0.03 | 5.00 | 24.0 | 112 |
| 1-5 | (I-21) | 5.0 | (II-15) | 15 | −0.04 | 5.45 | 23.2 | 117 |
| 1-6 | (I-21) | 5.0 | (II-65) | 13 | −0.05 | 5.00 | 22.0 | 120 |
| 1-7 | (I-22) | 6.0 | (II-15) | 15 | −0.02 | 5.30 | 24.5 | 113 |
| 1-8 | (I-22) | 6.0 | (II-65) | 13 | −0.03 | 5.20 | 23.8 | 115 |

Notes:
*Sensitivity: Difference from the sensitivity (log E) of sample 1-a as a standard. The sensitivity is expressed as the log of the exposure (log E) required to provide a density of 1.5.
**Dmax: Expressed as the density at an exposure just 0.5 lower as a log E value than the sensitivity point.
***Gradation (gamma): The gradient of the line joining the point of density 0.3 to the point of density 3.0 on the characteristic curve. A larger value indicates higher contrast.

EXAMPLE 2

An aqueous solution of silver nitrate and an aqueous solution of sodium chloride were mixed simultaneously in an aqueous gelatin solution which was being maintained at 30° C. 1 5 in the presence of $1.0\times10^{-4}$ mol of $NH_4RhCl_6$ per mol of silver and, after removing soluble salts using the methods well known in the industry, gelatin was added and 2-methyl4-hydroxy-1,3,3a,7-tetraazaindene was added without chemical ripening. This emulsion was a mono-disperse emulsion consisting of cubic crystals of average grain size 0.07μ.

The selected hydrazine compounds of formulae (I) and (II) shown in Table 2 were added in the quantities shown in Table 2 to this emulsion, and then the compound of which the formula is indicated below was added as a nucleation accelerator at a rate of 15 mg/m².

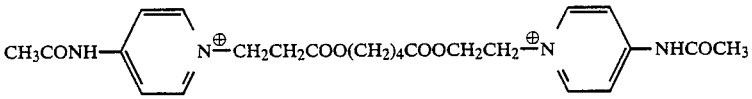

The following dyes were also added at the rate of 50 mg/m² each in order to improve the safety of the photosensitive material to safe-lighting.

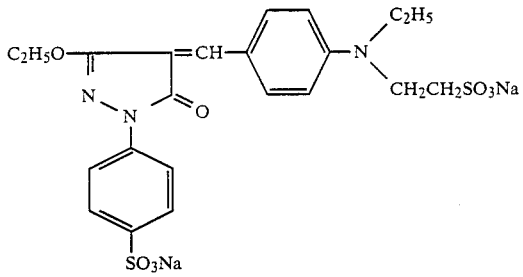

-continued

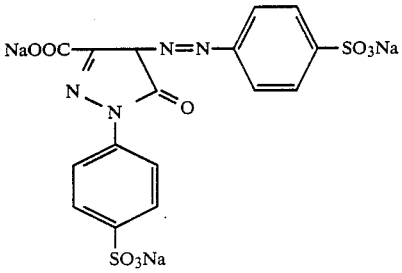

Moreover, poly(ethyl acrylate) latex was added at a rate of 30 wt % of the gelatin in terms of solid fraction, 1,3-vinylsulfonyl-2-propanol was added as a film hardening agent, and the resulting liquid was coated so as to provide a coated silver weight of 3.8 g/m² on a polyester support. The thus formed layer contained 1.8 g/m² of gelatin.

On the layer was further provided a layer containing 1.5 g/m² of gelatine, 55 mg/m² of the nucleating agent of which the formula is indicated below, 0.3 g/m² of poly(methyl methacrylate) of grain size 1.5μ as a matting agent and 5.0 mg/m² of thioctic acid as an anti-foggant. (1) Evaluation of Photographic Characteristics

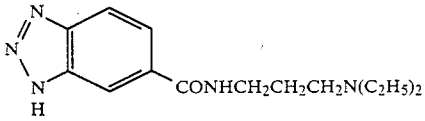

(1) Evaluation of Photographic Chararacteristics

Tests were carried out in the same way as in Example 1. The results were as shown in Table 2. The samples of this invention clearly had a high Dmax value and a high gamma value.

(2) The results obtained (see Table 2) on evaluating the physical properties of the films in the same way as in Example 1 showed that Comparative Examples 2-c and 2-d had a low wet strength and the other sample had a high wet strength.

(3) On carrying out a reducing treatment in the same way as in Example 1, a small reduction value of 8 to 9% was achieved with Comparative Examples 2-a and 2-b, whereas a high value of 14 to 16% was achieved with the samples of this invention. The gradation (gamma) was low with Comparative Examples 2-c and 2-d and reduction was not evaluated.

(4) Overall Evaluation

In view of all of the results in (1) to (3) above, it is clear that the samples of this invention showed the desired characteristics in all cases.

TABLE 2

| Sample No. | Compound of Formula (I) Type | Compound of Formula (I) Amount (mg/m²) | Compound of Formula (II) Type | Compound of Formula (II) Amount (mg/m²) | Photographic Characteristics Sensitivity* | Photographic Characteristics Dmax** | Photographic Characteristics Gradation*** (gamma) | Wet Film Strength (g) |
|---|---|---|---|---|---|---|---|---|
| Comp. Ex. | | | | | | | | |
| 2-a | Compound (I-1) | 18 | — | — | 0 | 3.90 | 19.3 | 115 |
| 2-b | (I-22) | 20 | — | — | ±0.0 | 3.65 | 18.0 | 117 |
| 2-c | — | — | Compound (II-15) | 74 | −0.10 | 2.53 | 7.4 | 51 |
| 2-d | — | — | (II-65) | 62 | −0.15 | 1.95 | 4.0 | 62 |
| The Invention | | | | | | | | |
| 2-1 | (I-1) | 11 | (II-15) | 15 | +0.02 | 5.80 | 22.5 | 111 |
| 2-2 | (I-1) | 11 | (II-65) | 13 | ±0.0 | 4.65 | 20.1 | 114 |
| 2-3 | (I-20) | 13 | (II-15) | 15 | −0.04 | 4.96 | 14.6 | 110 |
| 2-4 | (I-20) | 13 | (II-65) | 13 | −0.05 | 4.58 | 14.3 | 115 |
| 2-5 | (I-22) | 12 | (II-15) | 15 | +0.01 | 5.24 | 20.4 | 112 |
| 2-6 | (I-22) | 12 | (II-65) | 13 | ±0.0 | 4.80 | 19.2 | 114 |

EXAMPLE 3

Samples were prepared by using an equimolar amount of compound (2), (3), (6) or (9) in place of compound (1) of formula (I) in sample 1-1 in Example 1, and by using equimolar amounts of compound (II-3), (II-4), (II-5), (II-12), (II-19), (II-26), (II-46), (II-48) or (II-56) in place of the compound (II-15) of formula (II) in Sample 1-7.

The photographic characteristics, the physical and photographic properties of the films and reduction values were evaluated in the same way as in Example 1, and again the results obtained indicated that the samples of this invention gave an excellent performance.

While the invention has been described in detail and with reference to specific embodiments thereof, it will be apparent to one skilled in the art that various changes and modifications can be made therein without departing from the spirit and scope thereof.

What is claimed is:

1. An ultra-high contrast negative type silver halide photographic material comprising:

(1) at least one silver halide emulsion layer on a support;

(2) at least one compound selected from among hydrazine derivatives which can be represented by formula (I) below, which is included in said emulsion layer or in another hydrophilic colloid layer:

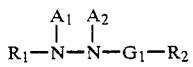

(I)

wherein $A_1$ and $A_2$ both represent hydrogen atoms or one represents a hydrogen atom and the other represents a sulfinic acid residual group or an acyl group, $R_1$ represents an aliphatic group, an aromatic group or a heterocyclic group, $R_2$ represents a hydrogen atom, an alkyl group, an aryl group, an alkoxy group, an aryloxy group, or an amino group, and $G_1$ represents a carbonyl group, a sulfonyl group, a sulfoxy group, a phosphoryl group or an N-substituted or unsubstituted iminomethylene group, and at least one of $R_1$ and $R_2$ has a group which promotes adsorption on silver halide; and (3) at least one compound selected from among the hydrazine derivatives which can be represented by formula (II) below, which is included in said emulsion layer or in another hydrophilic colloid layer:

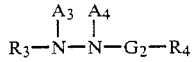

(II)

wherein $A_3$ and $A_4$ both represent hydrogen atoms or one represents a hydrogen atom and the other represents a sulfinic acid residual group or an acyl group, $R_3$ represents an aliphatic group, an aromatic group or a heterocyclic group, $R_4$ represents a hydrogen atom, an alkyl group, an aryl group, an alkoxy group, an aryloxy group or an amino group, $G_2$ represents a carbonyl group, a sulfonyl group, a sulfoxy group, a phosphoryl group, or an iminomethylene group, the total number of carbon atoms in $R_3$ and $R_4$ is at least 13 and $R_3$ and $R_4$ comprise no groups for promoting adsorption on silver halide.

2. An ultra-high constant negative type silver halide photographic material as in claim I, wherein the aliphatic groups represented by $R_1$ in formula (I) include linear chain, branched or cyclic alkyl groups, alkenyl groups or alkynyl groups.

3. An ultra-high contrast negative type silver halide photographic material as in claim 1, wherein the aromatic groups represented by $R_1$ are single ring or double ring aryl groups.

4. An ultra-high contrast negative type silver halide photographic material as in claim 1, wherein the heterocyclic rings represented by $R_1$ are 3- to 10-membered saturated or unsaturated heterocyclic rings which contain at least one nitrogen, oxygen or sulfur atom, and may be single rings or may taken the form of rings condensed with aromatic rings or other heterocyclic rings.

5. An ultra-high contrast negative type silver halide photographic material as in claim 4, wherein the heterocyclic groups represented by $R_1$ are 5- to 6-membered aromatic heterocyclic groups.

6. An ultra-high contrast negative type silver halide photographic material as in claim 1, wherein $R_2$ of formula (I) represents a hydrogen atom, an alkyl group, an aralkyl group, or an aryl group when G is a carbonyl group.

7. An ultra-high contrast negative type silver halide photographic material as in claim 6, wherein when $G_1$ is a carbonyl group, $R_2$ represents the hydrogen atom.

8. An ultra-high contrast negative type silver halide photographic material as in claim 1, wherein $R_2$ represents an alkyl group, an aralkyl group, an aryl group, or a substituted amino group when $G_1$ is a sulfonyl group.

9. An ultra-high contrast negative type silver halide photographic material as in claim 1, wherein $R_2$ is a cyanobenzyl group or methylthiobenzyl group when $G_1$ is sulfoxy group.

10. An ultra-high contrast negative type silver halide photographic material as in claim 1, wherein $R_2$ is a methoxy group, an ethoxy group, a butoxy group, a phenoxy group, or a phenyl group when $G_1$ is a phosphoryl group.

11. An ultra-high contrast negative type silver halide photographic material as in claim 10, wherein $R_2$ is a phenoxy group when $G_1$ is a phosphoryl group.

12. An ultra-high contrast negative type silver halide photographic material as in claim 1, wherein $R_2$ is a methyl group, an ethyl group, or a substituted or unsubstituted phenyl group when $G_1$ is an N-substituted or unsubstituted iminomethylene group.

13. An ultra-high contrast negative type silver halide photographic material as in claim 1, wherein groups which promote adsorption on silver halide which can be substituted into $R_1$ or $R_2$ can be represented by $X_1$-$(L_1)_m$, wherein $X_1$ is a group which promotes adsorption on silver halide, $L_1$ is a divalent linking group, and m has a value of 0 or 1.

14. An ultra-high contrast negative type silver halide photographic material as in claim 13, wherein $X_1$ is a thioamido group, a cyclic thioamido group, a mercapto group, groups which have a disulfide bond, or 5- or 6-membered nitrogen-containing heterocyclic groups.

15. An ultra-high contrast negative type silver halide photographic material as in claim 14, wherein the 5- or 6-membered nitrogen-containing heterocyclic rings which can be represented by $X_1$ consist of a combination of nitrogen, oxygen, sulfur and carbon atoms.

16. An ultra-high contrast negative type silver halide photographic material as in claim 14, wherein $X_1$ is represented by benzotriazole, triazole, tetrazole, indazole, benzimidazole, imidazole, benzothiazole, thiazole, benzooxazole, oxazole, thiadiazole, oxadiazole or triazine.

17. An ultra-high contrast negative type silver halide photographic material as in claim 14, wherein $X_1$ is represented by a cyclic thioamido group.

18. An ultra-high contrast negative type silver halide photographic material as in claim 1, wherein $A_1$ and $A_2$ represent hydrogen atom, an alkylsulfonyl group, or an arylsulfonyl group which has not more than 20 carbon atoms.

19. An ultra-high contrast negative type silver halide photographic material as in claim 18, wherein $A_1$ and $A_2$ represent a phenylsulfonyl group or a phenylsulfonyl group which has been substituted in such a way that the sum of the Hammett substituent constants is greater than −0.5.

20. An ultra-high contrast negative type silver halide photographic material as in claim 1, wherein $A_1$ and $A_2$ represent an acyl group which has not more than 20 carbon atoms.

21. An ultra-high contrast negative type silver halide photographic material as in claim 20, wherein $A_1$ and $A_2$ are represented by a benzoyl group or a benzoyl group which has been substituted in such a way that the sum of the Hammett substituent constants is more than −0.5, or a linear chain, branched or cyclic unsubstituted or substituted aliphatic acyl group.

22. An ultra-high contrast negative type silver halide photographic material as in claim 18, wherein $A_1$ and $A_2$ represent hydrogen atoms.

23. An ultra-high contrast negative type silver halide photographic material as in claim 1, wherein $G_1$ in formula (I) is a carbonyl group.

24. An ultra-high contrast negative type silver halide photographic material as in claim 1, wherein the compound represented by formula (I) is a compound represented by formula (III)

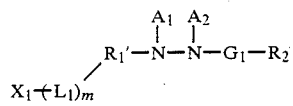

(III)

in which $R_1$ is a group in which one hydrogen atom has been removed from the group $R_1$ in formula (I), and at least one of the groups $R_1$, $R_2$ or $L_1$ is a group which can dissociate to form an anion of which the pKa value is at least 6, or an amino group, and wherein $X_1$ is a group which promotes adsorption on silver halide, $L_1$ is a divalent linking group, and m has a value of 0 or 1.

25. An ultra-high contrast negative type silver halide photographic material as in claim 24, wherein the group which can dissociate to provide an anion is a group which can dissociate to provide an anion of which the pKa value is 8 to 13.

26. An ultra-high contrast negative type silver halide photographic material as in claim 24, wherein the compound represented by formula (I) is represented by formula (IV)

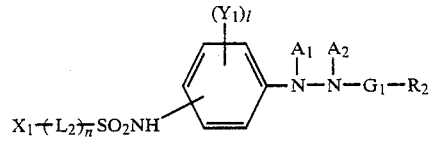

(IV)

in which $L_2$ is the same as $L_1$ in formula (III), $Y_1$ is a substituent group for $R_1$ in formula (I), n is 0 or 1, and ( is 0, 1 or 2, and when ( is 2 then the $Y_1$ groups may be the same or different.

27. An ultra-high contrast negative type silver halide photographic material as in claim 26, wherein the $X_1$-$(L_2)_n$-$SO_2NH$— group is substituted in the position para to the hydrazino group.

28. An ultra-high contrast negative type silver halide photographic material as in claim 1, wherein at least one of $R_3$ and $R_4$ in formula (II) contains a ballast group.

29. An ultra-high contrast negative type silver halide photographic material as in claim 28, wherein $R_3$ contains a ballast group.

30. An ultra-high contrast negative type silver halide photographic material as in claim 28, wherein the ballast group has at least 8 carbon atoms, consisting of an alkyl group, a phenyl group, an ether group, an amino group, a ureido group, a urethane group, a sulfonamido group, a thioether group, or a combination of these groups.

31. An ultra-high contrast negative type silver halide photographic material as in claim 29, wherein the ballast group has at least 8 carbon atoms, consisting of an alkyl group, a phenyl group, an ether group, an amino group, a ureido group, a urethane group, a sulfonamido group, a thioether group, or a combination of these groups.

32. An ultra-high contrast negative type silver halide photographic material as in claim 1, wherein the total number of carbon atoms in $R_3$ and $R_4$ is between 20 and 60.

33. An ultra-high contrast negative type silver halide photographic material as in claim 1, which contains the compound of either formula (I) or (II) in the silver halide emulsion layer and/or in another hydrophilic colloid layer in an amount of from $1\times10^{-6}$ mol to $1\times10^{-1}$ mol per mol of silver halide.

34. An ultra-high contrast negative type silver halide photographic material as in claim 1, which contains the compound of formula (I) in the silver halide emulsion layer and/or another hydrophilic colloid layer in an amount of from $1\times10^{-5}$ mol to $1\times10^{-2}$ mol per mol of silver halide.

35. An ultra-high contrast negative type silver halide photographic material as in claim 1, which contains the compound of formula (II) in the silver halide emulsion layer and/or another hydrophilic colloid layer in an amount of from $1\times10^{-4}$ molt to $4\times10^{-2}$ mol per mol of silver halide.

* * * * *